US007500291B2

(12) United States Patent
Matsumoto

(10) Patent No.: US 7,500,291 B2
(45) Date of Patent: Mar. 10, 2009

(54) WATERPROOF SLIDE FASTENER

(75) Inventor: Satoshi Matsumoto, Toyama-ken (JP)

(73) Assignee: YKK Corporation, Tokyo (JP)

( * ) Notice: Subject to any disclaimer, the term of this patent is extended or adjusted under 35 U.S.C. 154(b) by 117 days.

(21) Appl. No.: 11/529,116

(22) Filed: Sep. 28, 2006

(65) Prior Publication Data

US 2007/0074380 A1 Apr. 5, 2007

(30) Foreign Application Priority Data

Oct. 4, 2005 (JP) ..... 2005-291745

(51) Int. Cl.
*A44B 19/32* (2006.01)
*A44B 19/38* (2006.01)

(52) U.S. Cl. ..... 24/389; 24/434

(58) Field of Classification Search ..... 24/388, 24/433, 434, 389

See application file for complete search history.

(56) References Cited

U.S. PATENT DOCUMENTS

| | | | | |
|---|---|---|---|---|
| 3,616,939 | A * | 11/1971 | Potin | 24/433 |
| 4,244,087 | A * | 1/1981 | Akashi | 24/433 |
| 4,870,724 | A | 10/1989 | Fujisaki et al. | |
| 4,942,648 | A * | 7/1990 | Yoshida | 24/389 |
| 2006/0075612 | A1 * | 4/2006 | Wu | 24/433 |

FOREIGN PATENT DOCUMENTS

| | | | |
|---|---|---|---|
| EP | 0815765 | | 1/1998 |
| EP | 1348351 | A1 * | 10/2003 |
| EP | 1568290 | | 8/2005 |
| FR | 1440009 | | 5/1966 |
| GB | 1339303 | | 12/1973 |
| GB | 2079799 | A * | 1/1982 |
| GB | 2083548 | A * | 3/1982 |
| JP | 2004-283299 | | 10/2004 |
| JP | 2005-237577 | | 9/2005 |

* cited by examiner

*Primary Examiner*—James R Brittain
(74) *Attorney, Agent, or Firm*—Alston & Bird LLP

(57) ABSTRACT

There is provided a waterproof slide fastener comprising a plurality of fastener elements arranged along flat element mounting edge portions opposing each other of a pair of waterproof fastener tapes having a waterproof layer on a belt-like core material surface, an insert pin and a box pin fixed integrally to each flat end portion of the fastener tapes to oppose each other, a slider, and an insert pin fixing member extending from part of a side face on a tape end side of the insert pin over front and rear faces of the fastener tape such that the insert pin fixing member is fixed integrally thereto, wherein an end portion of the insert pin fixing member covers the front end face of the fastener tape on an insert pin fixing side so as to stride across the front and rear faces of the fastener tape.

6 Claims, 17 Drawing Sheets

WATERPROOF SLIDE FASTENER

BACKGROUND OF THE INVENTION

1. Field of the Invention

The present invention relates to a waterproof slide fastener in which a fastener tape thereof is coated with a waterproof layer composed of elastomer resin or the like, and more particularly, to a waterproof slide fastener in which a fastener tape having a waterproof layer on a surface of a woven or knitted belt-like core material is equipped with a separable bottom end stop, the waterproof slide fastener being capable of preventing an insert pin of the separable bottom end stop from dropping out of the fastener tape.

2. Description of the Related Art

A waterproof slide fastener is manufactured as follows. First, a fastener tape having a waterproof layer is produced by covering an entire surface of a belt body woven or knitted with fibers as a core material with natural rubber, synthetic rubber or elastomer resin composed of various synthetic resins. Then, fastener elements made of synthetic resin are molded integrally by injection molding such that each of them strides across front and rear faces along a side edge of the fastener tape. A pair of fastener stringers is obtained in the aforementioned way. Each of the fastener stringers having such a waterproof layer formed therein can block water from penetrating into the belt-like core material even if water adheres to a surface thereof.

After a slider is inserted through a fastener element row of one of the pair of fastener stringers thus obtained, a box pin is formed at a bottom end of the fastener element row of the fastener stringer so as to be continuous from the fastener element row and a box is molded integrally with the box pin as a separable bottom end stop. Further, an insert pin is mounted at a bottom end of a fastener element row of the other fastener stringer so as to be continuous from the fastener element row. Then, the fastener stringer having the box pin and the box mounted thereon and the fastener stringer having the insert pin mounted thereon are combined to produce a waterproof slide fastener.

As regards such a waterproof slide fastener, for example, Japanese Patent Application Laid-Open Publication No. (JP-A) 2005-237577 has disclosed a waterproof slide fastener in which a fixing strength between a fastener tape and fastener elements and a waterproof property of the slide fastener are improved, the slide fastener enabling a sliding operation of a slider to be executed more lightly.

The waterproof slide fastener 50 disclosed in JP-A 2005-237577 and shown in FIG. 21 is a slide fastener 50 having a waterproof structure comprised of a pair of fastener stringers 52 and a slider (not shown). In the pair of fastener stringers 52, a plurality of fastener elements 61 are molded integrally along opposing element mounting edges 51 of a pair of waterproof fastener tapes 55 each having a waterproof layer on its belt-like core materials. The slider engages/disengages the fastener elements 61. The slide fastener 50 has following characteristics.

That is, each fastener element 61 molded integrally on the fastener tape 55 comprises a coupling head 62, a neck portion 63, a body portion 64, a shoulder portion 65, and leg portions 66 extending from the body portion 64 inward of the fastener tape 55. The coupling head 62, the neck portion 63, the body portion 64, the shoulder portion 65 and the leg portions 66 are included in each of upper and lower half portions formed on front and rear faces of the fastener tape 55. The half portions are integrated by a connecting portion 67 through a through hole 54 formed in an element mounting edge portion 51 of the fastener tape 55. As a consequence, each fastener element 61 can be fixed firmly to a predetermined position of the fastener tape 55.

An edge 53 of the element mounting edge portion 51 is extended beyond the neck portion 63 of the fastener element 61, and a gap is formed between the upper and lower half portions of the coupling heads 62, so that when the fastener elements 61 are engaged, end faces of a pair of opposing fastener tapes 55 make a firm contact with each other. As a consequence, water or the like is blocked from penetrating from the front face to the rear face of the fastener tape 55 when the fastener elements 61 are engaged.

In the waterproof slide fastener described in JP-A 2005-237577, each half portion of the shoulder portion 65 and the leg portion 66 of the fastener element 61 is formed with a smaller thickness in a direction intersecting the front and rear faces of the fastener tape at right angle than each half portion of the neck portion 63 and the body portion 64. Two or more upper and lower half portions of the leg portion 66 are formed at a required interval in a sliding direction of the slider.

Consequently, when the slider is slid along the fastener elements 61, upper and lower flange portions of the slider are guided by the upper and lower half portions of the leg portions 66 of the fastener elements 61 in a sliding manner. For this reason, a sliding area in which the flange portions of the slider make a sliding contact with the leg portions 66 of the fastener elements 61 decreases. As a result, sliding resistance when the slider is slid can be decreased to allow the sliding operation of the slider to be executed smoothly. Further, according to JP-A 2005-237577, it has been said that the fixing strength of the fastener elements 61 to the fastener tape 55 can be increased by providing the fastener elements 61 with the leg portions 66.

In a normal type slide fastener with a separable bottom end stop in which no waterproof layer is formed in its fastener tapes like ones used ordinarily in an opening/closing portion of clothes or the like, the separable bottom end stop is hard to operate, that is, an operation of inserting the insert pin into the box is not easy to perform because elasticity of the fastener tape is high. Thus, in order to smoothly operate the separable bottom end stop, it has been known to stabilize a tape configuration by reinforcing a front end portion of each of the fastener tapes, for example, in such a manner that a reinforcing member such as a reinforcing rib is attached near the separable bottom end stop of the fastener tape.

For example, Japanese Patent Application Laid-Open Publication No. (JP-A) 2004-283299 has disclosed a slide fastener with a following configuration. That is, a pair of fastener tapes each having an element mounting edge portion including a woven or knitted core thread are woven or knitted, and a plurality of fastener elements are arranged along element mounting edge portions opposing each other of the pair of woven or knitted fastener tapes. A slider is inserted through the fastener elements, and a separable bottom end stop comprised of an insert pin, a box pin and a box is mounted to one end portion of the pair of fastener tapes. The slide fastener with the separable bottom end stop has following characteristics.

In the slide fastener with the separable bottom end stop described in JP-A 2004-283299, a reinforcing portion molded integrally with the separable bottom end stop is provided on at least one face of the fastener tape, the reinforcing portion is comprised of an inner side portion adjoining the separable bottom end stop and an outer side portion extending from the inner side portion, and the inner side portion and the outer side portion are constituted of a plurality of ribs.

In such a slide fastener with the separable bottom end stop, one end portion of the elastic fastener tape is reinforced by the reinforcing portion, so that its configuration is stabilized. Accordingly, for example, when the insert pin of the separable bottom end stop is inserted into the box provided on the other fastener stringer, an operation of inserting the insert pin into the box can be carried out stably by holding the reinforced end portion of the fastener tape. Further, the slide fastener of JP-A 2004-283299 can disperse an external force effectively by the ribs on the inner side even if a bending force or twisting force is applied to the end portion of the fastener stringer. In addition, the reinforcing portion can be deformed easily, thereby preventing the reinforcing portion from being damaged.

On the other hand, in the above-described waterproof slide fastener, for example, a configuration of the fastener tape itself is relatively stabilized because the fastener tape is covered with elastomer resin. For this reason, even if the reinforcing portion constituted of a plurality of ribs as disclosed in JP-A 2004-283299 or another reinforcing member is not provided in a vicinity of the separable bottom end stop of the waterproof slide fastener, the operation of inserting the insert pin into the box can be executed stably. If stiffness of the fastener tape is intensified by providing a reinforcing member and the like, the elasticity of the fastener tape is lost, so that the fastener tape cannot be deformed appropriately when the insert pin is inserted into the box, thereby possibly blocking an operation of smoothly inserting the insert pin. For this reason, generally, an end portion of the conventional waterproof slide fastener is provided with no reinforcing member, etc., but only with the separable bottom end stop.

In the waterproof slide fastener, the fastener tape is covered with elastomer resin in advance as described above, in order to secure a waterproof characteristic. Thus, when the fastener elements or the separable bottom end stop such as the insert pin is formed on an element mounting edge portion of the fastener tape by injection molding, resin material of the fastener element hardly penetrates into an inside of the tape as compared with an ordinary slide fastener having a fastener tape not coated with resin. As a consequence, the fixing strength of the fastener elements or the separable bottom end stop to the fastener tape decreases, which has been a problem to be solved.

The waterproof slide fastener 50 described in JP-A 2005-237577 is constituted such that the end faces of opposing fastener tapes 55 on element mounting edge portion sides make a firm contact with each other when the fastener elements 61 are engaged in order to enhance the waterproof property. Consequently, penetration of water or the like into a rear side from a front side of the slide fastener 50 is prevented. On the other hand, such a waterproof slide fastener 50 includes no core thread in the element mounting edge portions 51 for the reason of a constitution which brings the end faces of the fastener tapes 55 into a firm contact with each other sufficiently. For this reason, the waterproof slide fastener 50 of JP-A 2005-237577 needs to include a through hole 54 formed in the element mounting edge portion 51 in order to fix the fastener element 61 to the element mounting edge portion 51 firmly so that the upper and lower half portions of the fastener element 61 are fixed integrally by a connecting portion 67 through the through hole 54.

However, in an insert pin mounted on one end portion of the fastener tape 55, an insert pin mounting width from an edge of the fastener tape 55 is small because its configuration is narrow. Additionally, in a front end area of the fastener tape 55 on an insert pin fixing side, a front end portion (particularly a corner portion) of the fastener tape 55 is partially cut out when the insert pin is injection molded so as not to be exposed on an outer face of the insert pin. As a result, a contact area (fixing area) between the insert pin and the fastener tape 55 is very small.

The insert pin itself (particularly, a portion (groove) which nips the fastener tape 55) is easy to deform because its thickness is relatively small, and the insert pin likely receives a tensile stress or torsion as compared with the fastener element 61 when the slide fastener 50 is used.

Therefore, the waterproof slide fastener 50 having no core thread on its element mounting edge portion 51 has a following problem. That is, the insert pin is likely to slip out of the fastener tape 55 because the fixing strength of the insert pin is low and a portion nipping the fastener tape 55 of the insert pin is deformed and widened when it receives a stress or torsion during usage. Further, it can be considered to form the insert pin itself in a large size and in a large thickness to prevent the insert pin from slipping out. In this case, however, an elasticity of the fastener tape 55 is lost, thereby disabling operation of inserting the insert pin into the box.

When the operation of inserting the insert pin is repeated in the conventional waterproof slide fastener 50, the front end face of the fastener tape on the insert pin fixing side makes contact with a shoulder mouth of the slider, and a front end area of the fastener tape rubs against flanges of the slider. For this reason, the waterproof layer applied to the fastener tape 55 is worn, so that the fastener tape is likely to be unraveled or damaged. Consequently, waterproof performance of the slide fastener 50 is dropped.

SUMMARY OF THE INVENTION

The present invention has been achieved in view of the above-described problems, and an object of the invention is to provide a waterproof slide fastener in which an insert pin is prevented from slipping out of a fastener tape, and a front end portion of the fastener tape is protected from being unraveled or damaged, the waterproof slide fastener enabling an operation of inserting the insert pin into a box to be carried out smoothly.

In order to achieve the above object, a waterproof slide fastener according to the invention has a basic configuration in which a plurality of fastener elements are arranged along flat element mounting edge portions opposing each other of a pair of waterproof fastener tapes each having a waterproof layer for covering a surface of a belt-like core material, and an insert pin and a box pin are fixed integrally to both front and rear faces in a flat shape at end portions having no fastener elements of the pair of fastener tapes on one side in a longitudinal direction. The waterproof slide fastener includes a slider inserted through the fastener elements, and an insert pin fixing member extending from part of a side face on a tape end side of the insert pin over both the front and rear faces of one of the fastener tapes such that the fixing member is fixed integrally to the front and rear faces thereof. The waterproof slide fastener is most significantly characterized in that an end portion of the insert pin fixing member fixed integrally to the front and rear faces of the fastener tape covers a front end face of the fastener tape on an insert pin fixing side so as to stride across the front and rear faces of the tape.

Preferably, in the waterproof slide fastener according to invention, the insert pin fixing member is formed shorter than the insert pin in a tape length direction.

Further preferably, in the waterproof slide fastener according to the invention, at least one through hole is formed in an area including the insert pin and the insert pin fixing member of the fastener tape, and front and rear faces of the insert pin and insert pin fixing member fixed on both the front and rear faces of the tape are connected by a connecting portion through the through hole in the fastener tape.

It is preferable that the waterproof slide fastener according the invention further comprises upper and lower plate members extending outwardly with a predetermined gap in parallel to the front and rear faces of the fastener tapes, the plate members being provided on both the front and rear faces on an end portion of the insert pin on a fastener element side. In addition, preferably, the gap between the upper and lower plate members is formed to be larger than a thickness of the fastener tape to which the box pin has been fixed, and when the fastener elements are engaged, the gap between the upper and lower plate members accommodates part of an edge of the fastener tape on a box pin side.

It is also preferable that part of an end portion of the fastener tape disposed at the end portion of the insert pin on the fastener element side is formed so as to project into the gap, and a length of a projection into the gap is a length which brings the end face of the fastener tape projecting from the gap into a firm contact with the end face of the fastener tape on the side at which the opposing box pin is fixed when the fastener elements are engaged.

Furthermore, it is preferable that the lower plate member disposed on the rear face of the insert pin is formed in a predetermined length in a tape length direction from the end portion of the insert pin on the fastener element side.

Moreover, leg portions smaller than the insert pin fixing member are preferably disposed on a side face of the insert pin on a side having the insert pin fixing member.

In the slide fastener having the waterproof performance of the present invention, the insert pin fixing member is fixed to both the front and rear faces of the fastener tape such that it is extended from part of a side face on the tape end side of the insert pin fixed to a flat end portion of the fastener tape, and the end portion of the insert pin fixing member covers the front end face of the fastener tape on the insert pin fixing side such that it strides across the front and rear faces of the fastener tape. By fixing the insert pin fixing member to both the front and rear faces on the front end portion of the tape integrally with the insert pin such that it strides over the front end face of the fastener tape on the insert pin fixing side, a fixing area between the insert pin/insert pin fixing member and the fastener tape can be increased to intensify the fixing strength of the insert pin to the fastener tape. Further, even if the insert pin receives a stress or torsion, the insert pin and the tape end portion are hard to deform because the insert pin fixing member is fixed to both the front and rear faces striding over the front end face of the fastener tape on the insert pin fixing side. As a consequence, the insert pin can be effectively prevented from slipping out of the fastener tape of the waterproof slide fastener.

In the conventional slide fastener described in JP-A 2004-283299, there in forcing portion molded integrally with the separable bottom end stop is, as described above, provided to stabilize the configuration of the fastener tape end portion and to allow the insert pin of the separable bottom end stop to be inserted into the box stably. However, the insert pin fixing member molded integrally with the insert pin of the present invention is provided to intensify the fixing strength between the fastener tape and the insert pin and to prevent the insert pin from slipping out of the fastener tape. That is, a configuration and a purpose thereof are different from those of the conventional slide fastener.

Further, the front end portion of the fastener tape is protected by the insert pin fixing member so as to be wrapped because the insert pin fixing member is provided striding over the front end face of the fastener tape on the insert pin fixing side. Accordingly, even if an operation of inserting the insert pin into the box is repeated, the front end portion of the tape can be prevented from being unraveled or damaged to maintain an excellent waterproof characteristic of the slide fastener.

In the waterproof slide fastener of the present invention, the insert pin fixing member is formed shorter than the insert pin in a tape length direction. As a result, an area in which the fastener tape is exposed exists beside an insert pin side portion from a top of the insert pin to a top of the insert pin fixing member. By providing the area in which the fastener tape is exposed above the insert pin fixing member, the elasticity of the fastener tape is not lost and deformation and deflection of the fastener tape can be allowed even if the insert pin fixing member is fixed to both the front and rear faces of the tape. Consequently, the operation of inserting the insert pin can be carried out easily and smoothly by deforming the fastener tape appropriately when the insert pin is inserted into the box.

Further, in the waterproof slide fastener of the present invention, at least one through hole is formed in an area of the fastener tape in which the insert pin and the insert pin fixing member are disposed. The insert pin and the insert pin fixing member provided on the front face and rear face of the tape are connected by the connecting portion through the through hole. As a consequence, the fixing strength between the insert pin and the insert pin fixing member can be intensified.

Particularly, the through hole can be formed in a tape inside area apart from the end portion and an edge of the fastener tape because the insert pin fixing member is molded integrally with the insert pin. More specifically, because the conventional waterproof slide fastener includes no insert pin fixing member and the insert pin itself is formed in a narrow shape, the through hole can be formed only at a place very near the tape end portion or edge thereof even when the through hole is formed. For this reason, when the insert pin receives a tensile stress or torsion, the fastener tape itself is cut out, so that the insert pin is likely to slip out. However, according to the present invention, the through hole can be formed in the tape inside area, whereby the fastener tape is never cut out, thereby securely preventing the insert pin from dropping out of the fastener tape.

The waterproof slide fastener of the invention includes an upper plate member (upper plate) provided on the front face of the insert pin, and the lower plate member (lower plate) provided on the rear face of the insert pin. The upper plate member extends to a front face side of an opposing fastener tape while the lower plate member extends to rear face sides of the opposing fastener tape and the box pin. A predetermined gap is formed between the upper plate and the lower plate. Accordingly, in a fastener stringer on the box pin side, an edge of the fastener tape is extended from the fastener element provided on a bottom end of an element row, and when the fastener elements are engaged, part of the edge of the fastener tape on the box pin side is inserted into the gap formed between the upper plate and the lower plate and accommodated therein. By inserting the edge of the fastener tape on the box pin into the gap, a gap generated between opposing fastener stringers when the fastener elements are engaged is reduced, thereby improving the waterproof performance of the slide fastener.

A tape nipping groove portion is formed in an element side end portion of the insert pin, and the fastener tape is projected into the gap between the upper and lower plates through the tape nipping groove. As a result, when the fastener elements are engaged, an end face of the fastener tape projected from the insert pin can be brought into a firm contact with an end face of the fastener tape on the box pin side inserted into the gap formed between the upper and lower plates of the insert pin not only in an area equipped with the fastener elements but also in an area including the tape nipping groove portion in the insert pin. Consequently, the waterproof performance of the slide fastener can be improved.

Further, according to the present invention, the lower plate extending to the rear face side of the box pin is formed on the rear face of the insert pin in a predetermined length from an element side end portion of the insert pin. Accordingly, water or the like can be prevented from invading from the front face to the rear face of the slide fastener by means of the lower plate, thereby further improving the waterproof performance.

Moreover, the waterproof slide fastener of the present invention has leg portions on a side face on a side of the insert pin having the insert pin fixing member. This makes it possible to prevent the waterproof layer for covering the front face of the fastener tape from being worn due to contact with a flange of the slider when the slider mounted on the fastener elements is slid. Further, each of the leg portions formed on the tape end side of the insert pin is smaller than the insert pin fixing member, and a plurality of leg portions are disposed at an interval, whereby the fastener tape in an area including the leg portions is not made rigid but can be deformed easily. Accordingly, when the insert pin is inserted into the box, the operation of inserting the insert pin can be carried out easily and smoothly by deforming the fastener tape appropriately.

DESCRIPTION OF THE PREFERRED EMBODIMENTS

Hereinafter, one embodiment of the present invention will be described in detail with reference to accompanying drawings.

Figure 1:
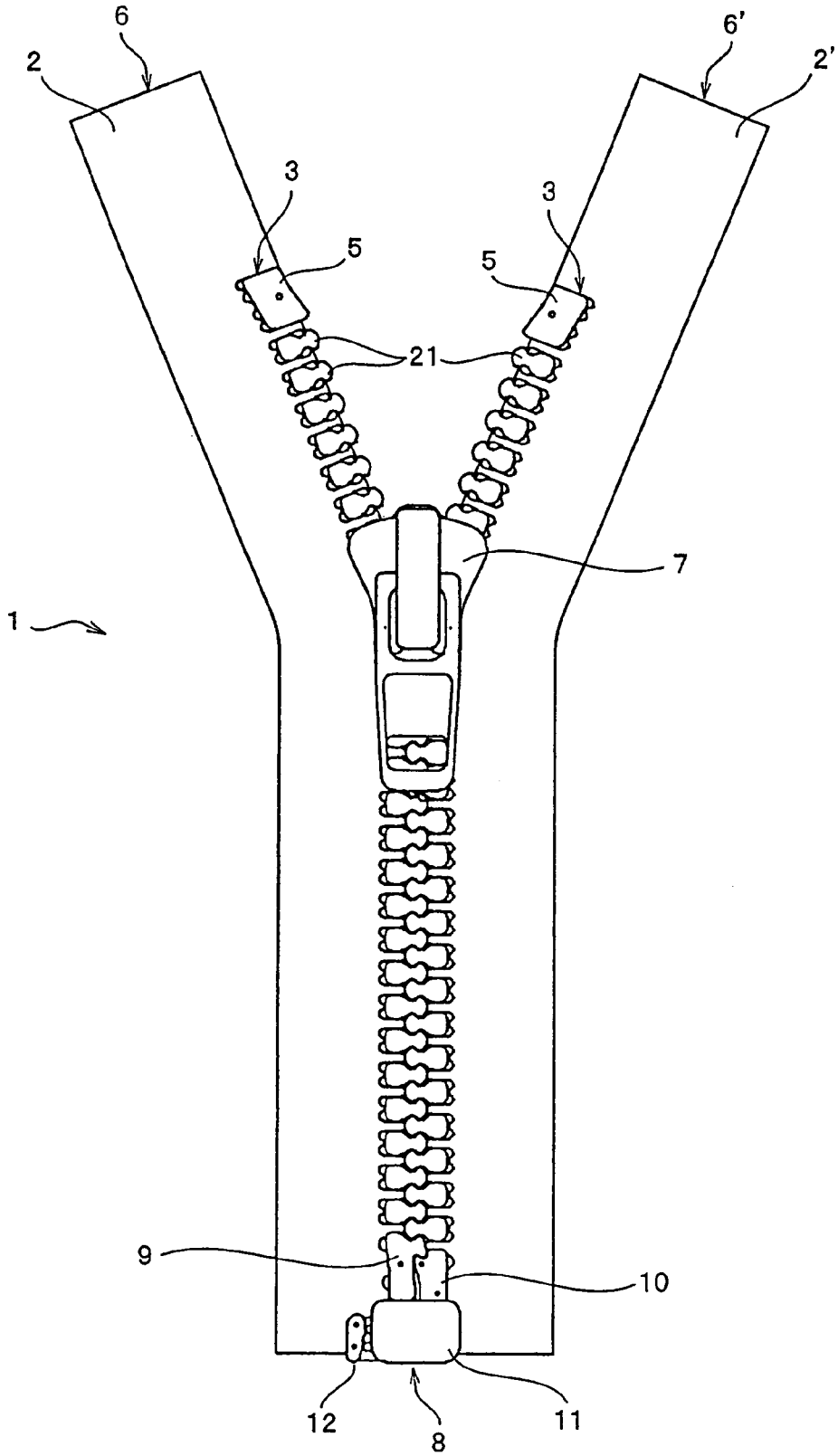
FIG. 1 is a plan view showing an entire waterproof slide fastener of the present invention.
Figure 2:
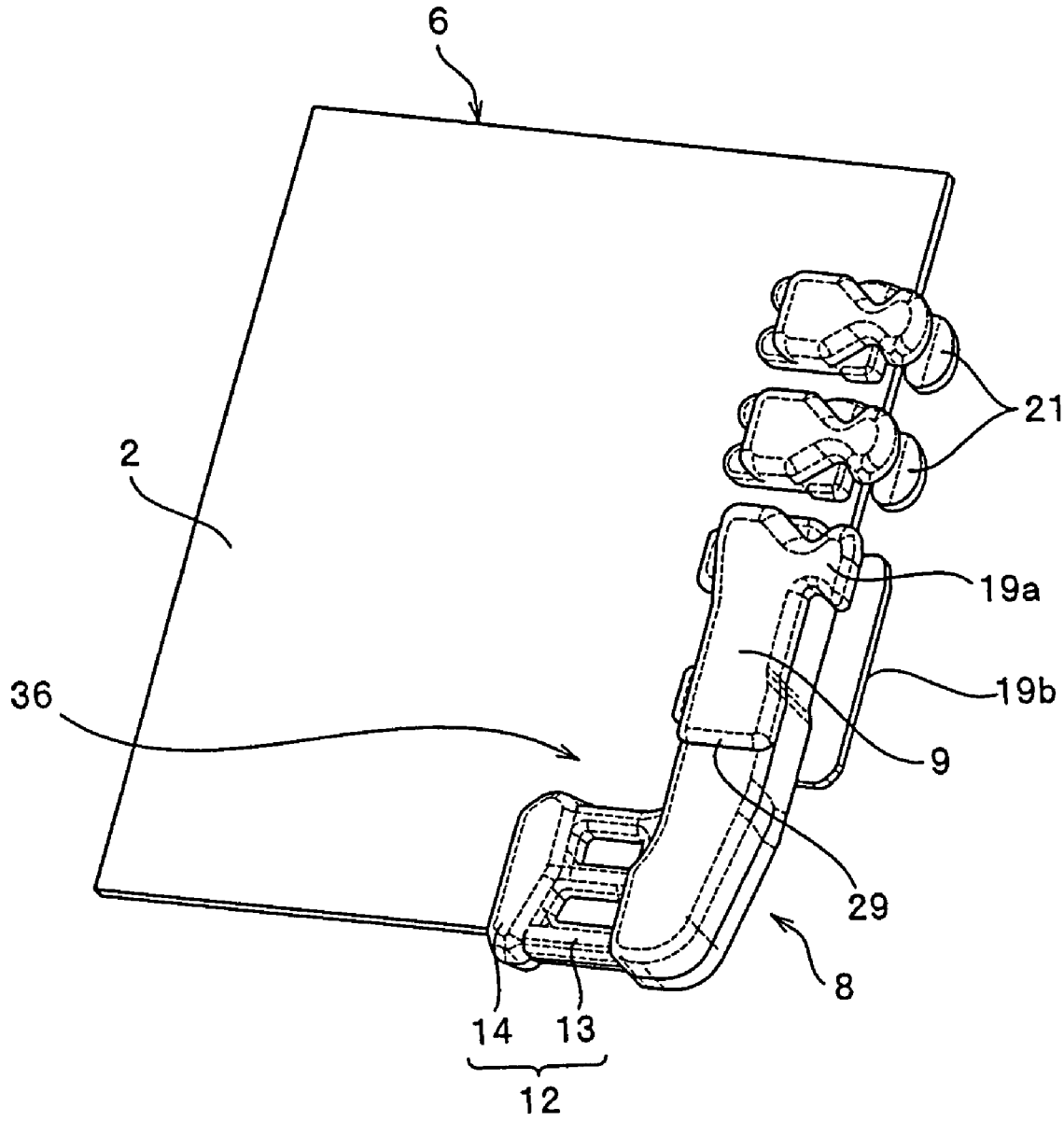
FIG. 2 is a perspective view showing major portions of a fastener stringer on a side at which an insert pin is attached.
Figure 8:
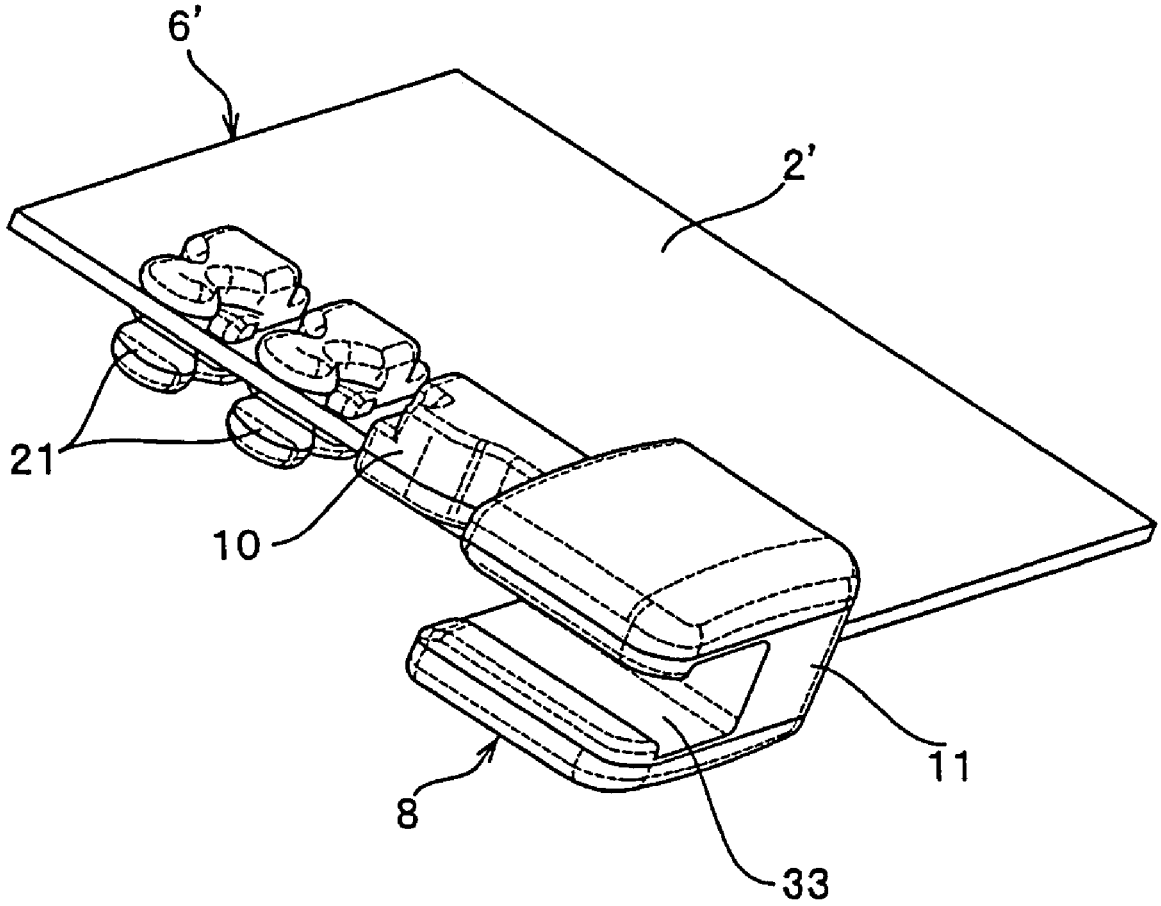
FIG. 8 is a perspective view showing major portions of a fastener stringer on a side at which a box pin and a box are attached.
Figure 9:
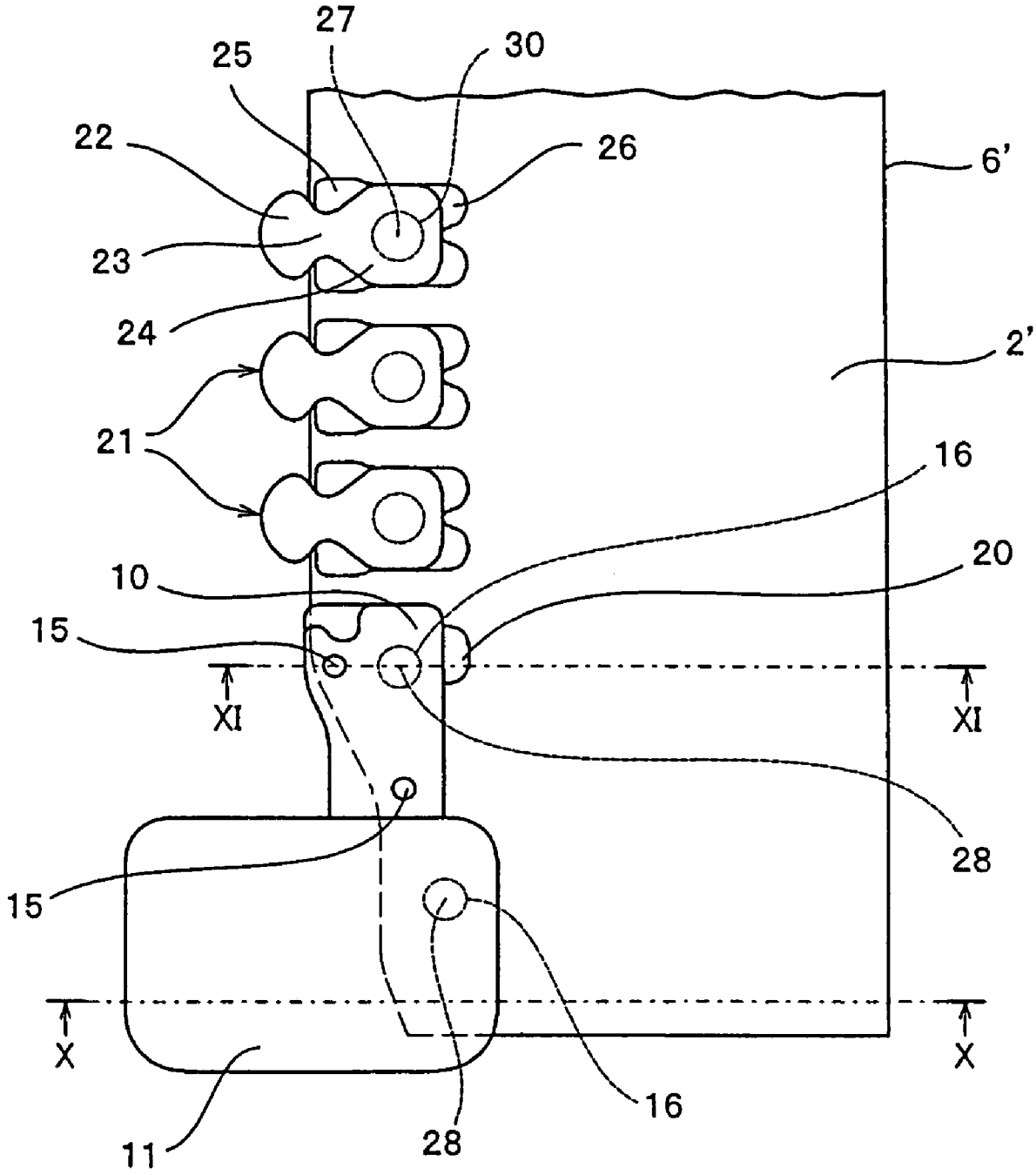
FIG. 9 is a front view showing major portions of the fastener stringer on the side at which the box pin and box are attached.

FIG. 1 is a plan view showing an entire waterproof slide fastener according to the embodiment, FIG. 2 is a perspective view showing major portions of a fastener stringer on a side at which an insert pin is attached, and FIG. 8 is a perspective view showing major portions of a fastener stringer on a side at which a box pin and a box are attached.

In a waterproof slide fastener 1 shown in FIG. 1, a plurality of fastener elements 21 are arranged a long a flat element mounting edge portion 3 which is one side edge portion of a pair of fastener tapes 2, 2' coated with elastomer resin so as to form a fastener element row, and an end stop 5 is provided at one end portion of the fastener element row of each of the fastener tapes 2, 2' to construct fastener stringers 6, 6'.

A slider 7 which engages/disengages the fastener elements 21 is mounted on the fastener element rows of the pair of fastener stringers 6, 6'. Further, an insert pin 9 which constitutes a separable bottom end stop 8 continuously from the fastener elements 21 is fixed integrally to a bottom end portion of one fastener stringer 6. A box pin 10 which constitutes the separable bottom end stop 8 continuously from the fastener elements 21 is fixed integrally to a bottom end portion of the other fastener stringer 6', and a box 11 is molded integrally with a bottom portion of the box pin 10.

The fastener tapes 2, 2' are manufactured by a similar way as a conventional one, that is, by forming a waterproof layer in such a manner that an entire surface of a belt-like core material composed of woven or knitted fabric is covered with a natural or synthetic rubber material or an elastomer resin material composed of various synthetic resins such as polypropylene, polycarbonate, polystyrene terephthalate, polybutylene, vinyl chloride, polyamide, and high density polystyrene.

The element mounting edge portion 3 of each of the fastener tapes 2, 2' is provided with no core thread, and the element mounting edge portion 3 is formed in a flat form. An element fixing through hole 30 having a size large enough for raw material resin in a melting state for a fastener element 21 to be able to go through is formed at each element molding position of the element mounting edge portion 3.

First, the fastener stringer 6 to which the insert pin 9 is fixed and integrated will be described in detail with reference to FIGS. 2 to 7.

According to this embodiment, each of the fastener elements 21 arranged on the element mounting edge portion 3 of the fastener tape 2 is integrated with the fastener tape 2 by injection molding thermoplastic synthetic resin such as, for example, polyamide, polyacetal, polypropylene, and polybutylene terephthalate. The fastener element of this embodiment has substantially the same configuration as a fastener element adopted to the waterproof slide fastener described in JP-A 2005-237577.

Figure 3:
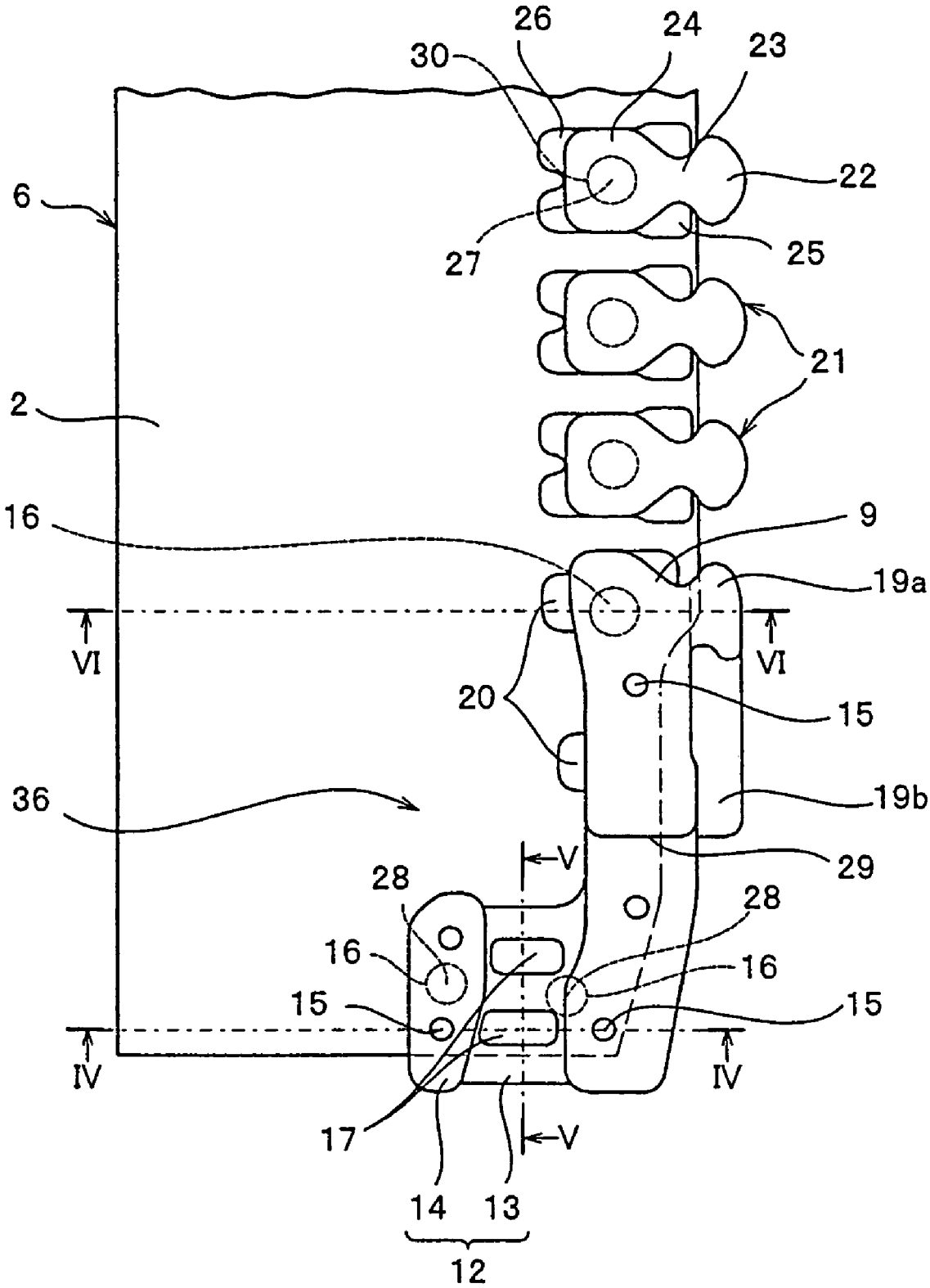
FIG. 3 is a front view showing major portions of the fastener stringer on the side at which the insert pin is attached.

More specifically, as shown in FIG. 3, each fastener element 21 is comprised of a coupling head 22 which provides an oval shape slightly longer in its element width direction, a body portion 24 which provides a substantially hexagonal shape as seen in its plan view, the body portion 24 being connected to the coupling head 23 through a neck portion 23, wing-like shoulder portions 25 provided on right and left across the neck portion 23 and the body portion 24, and leg portions 26 extended as two branches in an element length direction from the body portion 24.

The neck portion 23, the body portion 24, the shoulder portions 25 and the leg portions 26 are tightly fixed to the element mounting edge portion 3 of the fastener tape 2. The thickness of the neck portion 23 and the body portion 24 in a direction intersecting front and rear faces of the fastener tape at right angle is the largest while the shoulder portions 25 and the leg portions 26 are formed in a thickness about ⅓ of those of the neck portion 23 and the body portion 24. A plurality of fastener elements 21 having such a configuration are arranged on the element mounting edge portion 3, whereby a sliding resistance which occurs when the slider is slid can be reduced to allow the slider to slide lightly without damaging the fastener tape 2.

Because the leg portions 26 are extended as two branches from the body portion 24, a mold can press and fix the fastener tape 2 using a gap existing between the two leg portions 26 when the fastener elements 21 are injection molded. As a consequence, the fastener elements 21 can be molded integrally with the tape 2 in a stable manner without generating flexure on the tape 2.

In the fastener element 21, half portions of the coupling head 22, the neck portion 23, the body portion 24, the shoulder portions 25 and the leg portions 26 are symmetrically formed on front and rear sides of the fastener tape 2 interposing the fastener tape 2 therebetween. The half portions of the body portion 24 of tape front side and tape rear side of the fastener element 21 are connected by the connecting portion 27 through the element fixing through hole 30 formed in the fastener tape 2, so that the half portions of the tape front side and rear side are integrated with each other.

An edge of the element mounting edge portion 3 of the fastener tape 2 is extended by a predetermined length beyond the neck portion 23 of the fastener element 21. At a flat end portion having no fastener element 21 of the fastener tape 2, an insert pin 9 and an insert pin fixing member 12 extending over the fastener tape 2 from part of a side face of the insert pin 9 are fixed integrally to the front and rear faces of the fastener tape 2. The insert pin 9 and insert pin fixing member 12 are fixed integrally to the fastener tape 2 by injection molding the same thermoplastic synthetic resin as the fastener element 21.

According to this embodiment, a portion in a fixing side front end area of the insert pin 9 in the fastener tape 2 is cut out in advance so that the insert pin 9 of the fastener tape 2 is not exposed outside after the insert pin 9 is injection molded. Three fixing through holes 16 are formed in advance in a area of the fastener tape 2 in which the insert pin 9 and the insert pin fixing member 12 are to be fixed. The insert pin 9 and insert pin fixing member 12 on the front and rear sides of the tape are connected by a connecting portions 28 provided through the three fixing through holes 16. As a consequence, the insert pin 9 and the insert pin fixing member 12 can be securely fixed to the fastener tape 2 with an excellent fixing strength.

The insert pin fixing member 12 molded integrally with the insert pin 9 strides across the front and rear faces of the tape 2 so as to cover an insert pin fixing side front end face of the fastener tape 2, so that the insert pin fixing side front end portion of the fastener tape 2 is wrapped by the insert pin fixing member 12. Consequently, a fixing area between the insert pin 9 and insert pin fixing member 12 which are molded integrally and the fastener tape 2 is increased, and thus, the fixing strength of the insert pin 9 and the insert pin fixing member 12 to the fastener tape 2 is intensified remarkably. Thereby, the insert pin 9 can be prevented from slipping out of the fastener tape 2 even if the fastener tape 2 receives a stress or torsion.

If the insert pin fixing member 12 is formed striding across the front and rear faces of the fastener tape 2, the insert pin fixing side front end portion of the fastener tape 2 is protected by the insert pin fixing member 12 and not exposed. This makes it possible to prevent the front end portion of the fastener tape 2 from being unraveled or damaged, and at a same time, to prevent the insert pin fixing member 12 from being separated from the fastener tape 2.

Figure 4:
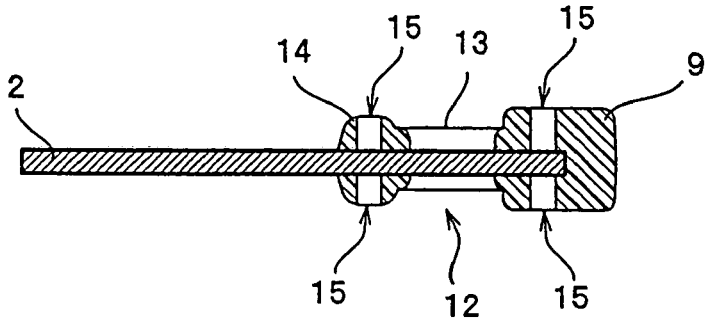
FIG. 4 is a sectional view seen in a direction of arrows along a line IV-IV in FIG. 3.
Figure 5:
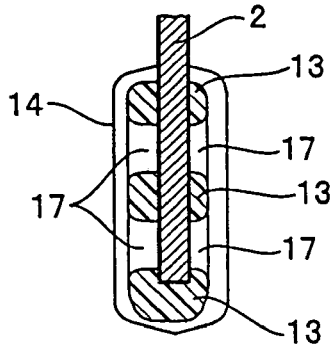
FIG. 5 is a sectional view seen in a direction of arrows along a line V-V in FIG. 3.

As shown in FIG. 4, the insert pin fixing member 12 is comprised of a thin portion 13 extending from the side face of the insert pin 9, and a rib 14 adjoining the thin portion 13. The thin portion 13 and the rib 14 are formed shorter than the insert pin 9 in a tape length direction. By forming the insert pin fixing member 12 shorter than the insert pin 9, the fastener tape 2 can be exposed in an upper area 36 stretching up to a top end portion of the insert pin 9 above the insert pin fixing member 12. Consequently, for example, when the insert pin 9 is inserted into the box 11, the fastener tape 2 can be deformed appropriately by allowing deformation or flexure of the fastener tape 2, so that an insertion of the insert pin 9 can be carried out easily and smoothly.

At this time, a length of the insert pin fixing member 12 is set to not more than 60% of a length of the insert pin 9, preferably not more than 50%, and more preferably not more than 40%. On the other hand, a size of the insert pin fixing member 12 in a tape width direction is selected arbitrarily depending on an application purpose of a product. However, it is preferred to be 1.5 times or more and 5 times or less, particularly 2 times or more and 4 times or less an average size of the insert pin 9 in the width direction.

As shown in FIG. 4, the insert pin 9 and the rib 14 each have a hole portion 15 in a circular shape respectively which reaches the fastener tape 2. The hole portion 15 is formed in such a manner that a tape pressing member presses the fastener tape 2 when the insert pin 9 and the insert pin fixing member 12 are injection molded. Further, the thin portion 13 of the insert pin fixing member 12 has two rectangular hole portions 17.

Like the hole portion 15, each of the hole portions 17 is formed in such a manner that the tape pressing member presses the fastener tape 2, and may be circular as well as rectangular. The hole portions 17 are larger than the hole portion 15. This is because the tape pressing member presses the fastener tape 2 through a wide area at the time of injection molding so as to prevent the fastener tape 2 from being displaced securely.

An upper plate 19*a* extending to a front face side of the opposing fastener tape 2' is disposed on an end portion front face of the insert pin 9 on the fastener element side, while a lower plate 19*b* extending to a rear face side of the fastener tape 2' and the box pin 10 is disposed on a rear face of the insert pin 9. The lower plate 19*b* is formed longer in a longitudinal direction of the fastener tape 2 than the upper plate 19*a*.

The upper plate 19*a* provided on the insert pin 9 is formed in a same shape as the coupling head 22 and the neck portion 23 of the fastener element 21. The lower plate 19*b* is formed from a fastener element side end portion of the insert pin 9 to about half position of the insert pin 9 so as to be in contact with an end face of the box 11 on an insert pin inserting side when the box pin 9 is inserted in the box 11. Furthermore, a concave portion is formed in an end portion of the lower plate 19*b* on the fastener element side. On the other hand, a concave portion which engages the upper plate 19*a* in the insert pin 9 is formed in an end portion of a front face of the box pin 10 described later on the fastener element side. Consequently, when the fastener elements 21 are engaged, top end portions of the upper plate 19*a* and the lower plate 19*b* of the insert pin 9 can be engaged with the top end portions of the fastener element 21 and the box pin 10 fixed to an element row bottom end of the fastener tape 2' on a box pin side.

Figure 6:
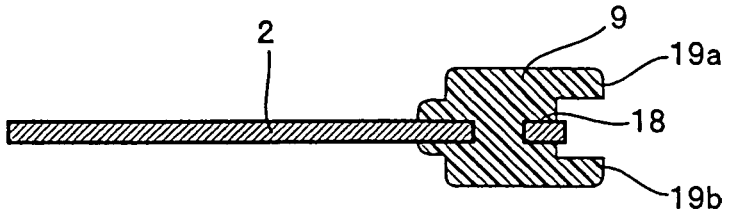
FIG. 6 is a sectional view seen in a direction of arrows along a line VI-VI in FIG. 3.
Figure 7:
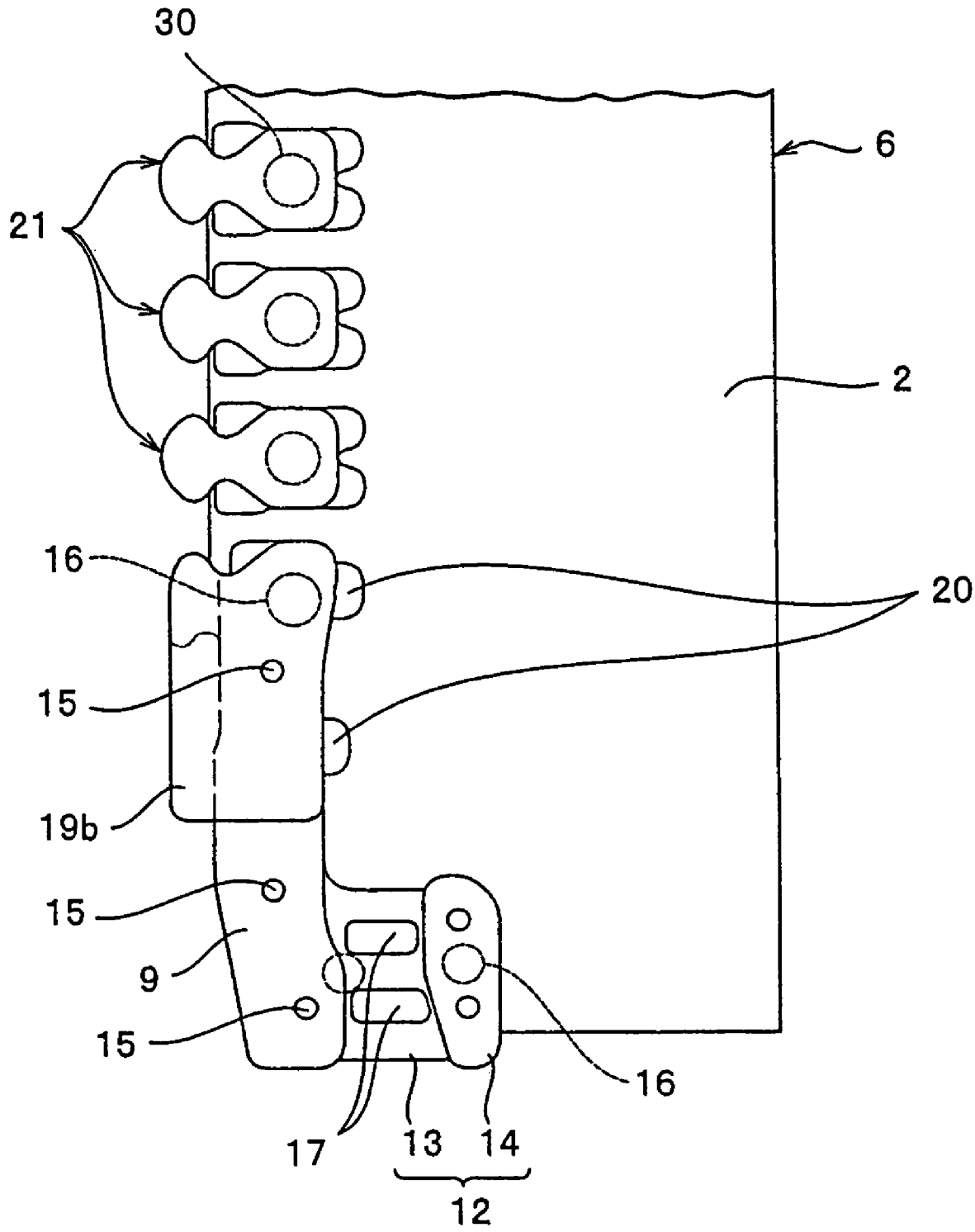
FIG. 7 is a rear view showing major portions of the fastener stringer on the side at which the insert pin is attached.

As shown in FIG. 6, a predetermined gap is formed between the upper plate 19*a* and the lower plate 19*b* of the insert pin 9, so that an edge of the fastener tape 2' on an opposing box pin side can be inserted into the gap between the upper and lower plates 19*a*, 19*b* when the fastener elements 21 are engaged. A tape nipping groove portion 18 for nipping the fastener tape 2 is formed in an end portion of the insert pin 9 on a side of the fastener element 21. The fastener tape 2 is extended so as to project in the tape width direction from the insert pin 9 through the tape nipping groove portion 18, so that the end of the fastener tape 2 is exposed in the gap between the upper plate and the lower plate.

Leg portions 20 having a smaller thickness than the insert pin 9 are provided so as to project in a width direction of the fastener tape 2 on the side face of the insert pin 9 on the side having the insert pin fixing member 12. The leg portions 20 are arranged on a front and rear faces of the fastener tape 2 with intervals in a longitudinal direction of the fastener tape 2 with respect to the insert pin fixing member 12 and the leg portions 20 on both faces of the fastener tape 2 tightly contact an opposing face of the fastener tape 2. Consequently, the leg portions 20 make contact with flanges of the slider when the slider is slid as described in detail below, so that a frequency of the flanges' contact with the waterproof layer covering the fastener tape 2 can be reduced. This makes it possible to prevent wearing of the waterproof layer due to contact with the flanges of the slider.

Each of the leg portions 20 is smaller than the insert pin fixing member 12, and a plurality of them are provided at a predetermined interval. Consequently, even if the leg portions 20 are disposed, the elasticity of the fastener tape can be secured in an area provided with the leg portions 20, thereby enabling the insertion of the insert pin into the box to be carried out easily and smoothly.

Further, the insert pin 9 has a step portion 29, which makes contact with the box 11 to position the insert pin 9 when the insert pin 9 is inserted into the box 11.

Next, the fastener stringer 6' to which the box pin 10 and the box 11 are fixed integrally will be described with reference to FIGS. 8 to 12.

Each of fastener elements 21 arranged along the element mounting edge portion 3 of the fastener tape 2' in the fastener stringer 6' is the same as the fastener element 21 arranged on the fastener stringer 6 including the insert pin 9 fixed thereto. The body portion 24 on the front side and rear side of the tape are connected by the connecting portion 27 through the element fixing through hole 30 formed in the fastener tape 2', so that the half portions on the front side and the rear side of the fastener tape 2' are combined.

In the fastener stringer 6' also, the edge of the element mounting edge portion 3 of the fastener tape 2' is extended by a predetermined length beyond the neck portion 23 of the fastener element 21. The box pin 10 is fixed to one end portion of the fastener tape 2' including no fastener element 21 such that the box pin is continuous to the fastener element 21 as described previously. Further, the box 11 is attached to the lower portion of this box pin 10 integrally with the box pin 10.

Moreover, part of the fastener tape 2' in a front end area on a side at which the box pin 10 and the box 11 are fixed is cut out in advance so that the fastener tape 2' is not exposed from outer faces of the box pin 10 and the box 11. Two fixing through holes 16 are formed in advance in the area of the fastener tape 2' in which the box pin 10 and the box 11 are fixed, and the box pin 10 and the box 11 are connected from the front to the rear side of the fastener tape 2' by the connecting portions 28 through the fixing through holes 16. Consequently, the box pin 10 and box 11 can be secured to the fastener tape 2' with an excellent fixing strength.

Figure 10:
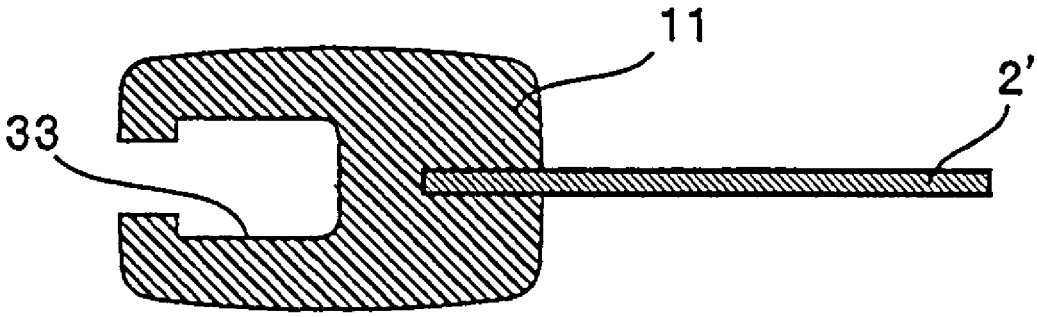
FIG. 10 is a sectional view seen in a direction of arrows along a line X-X in FIG. 9.

In the fastener stringer 6', the box 11 formed thick stably nips a predetermined area of the fastener tape 2' as shown in FIG. 10. Such a thick box 11 is hard to deform even if it receives a stress or torsion, and the fastener tape 2' is unlikely to slip out of the box 11. For this reason, the box pin 10 and the box 11 can be prevented from loosing out of the fastener tape 2' even if no fixing member is formed unlike the insert pin 9. An insert pin insertion hole 33 for inserting the insert pin 9 when the insert pin 9 is inserted into the box 11 is formed in the box 11. In the meantime, it is permissible to mold the box pin and box separately and then combine the box pin and box by fusion. In this case, it is preferable to form the fixing member on the box pin like the insert pin.

Figure 11:
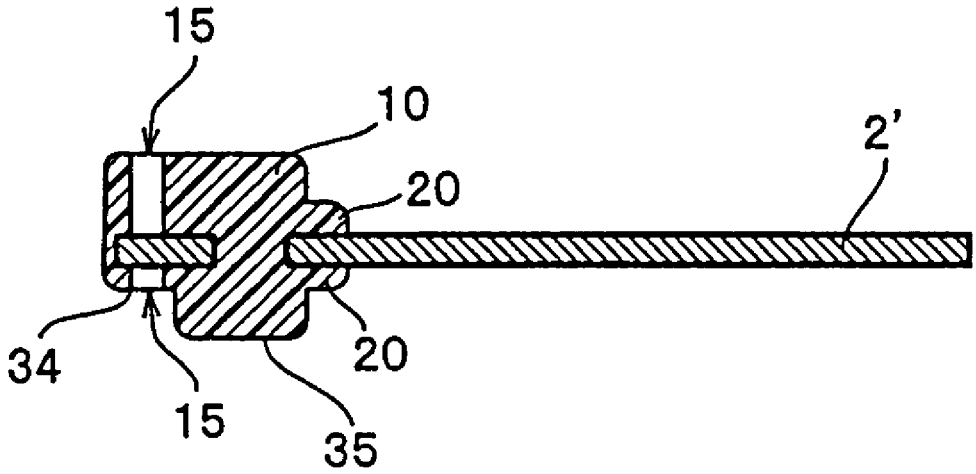
FIG. 11 is a sectional view seen in a direction of arrows along a line XI-XI in FIG. 9.
Figure 12:
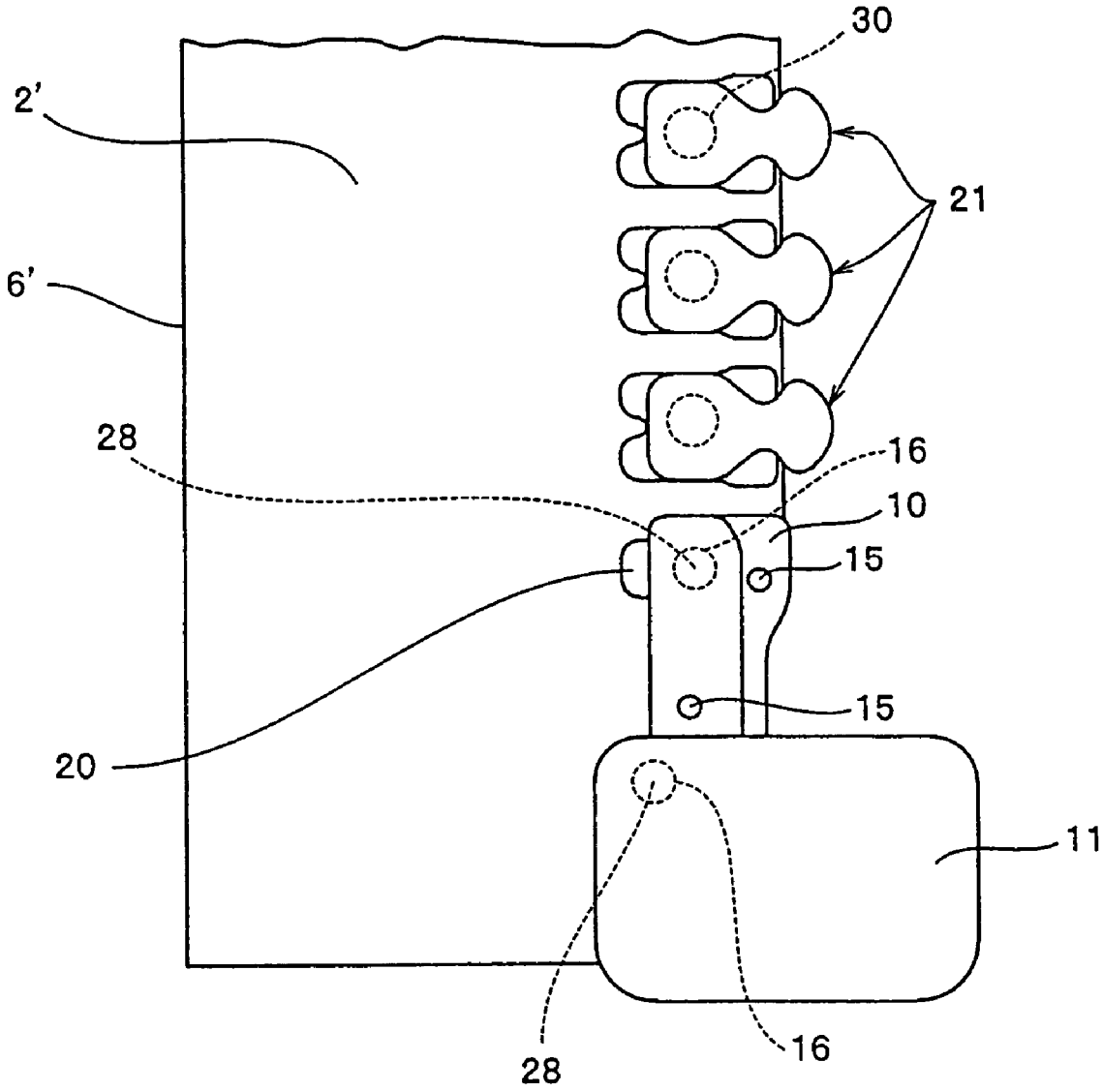
FIG. 12 is a rear view showing major portions of the fastener stringer on the side at which the box pin and box are attached.

As shown in FIG. 11, on the rear side of the box pin 10, a recess portion 34 having a small thickness is formed on an outer side face of the box pin 10 opposing the insert pin 9 and a protrusion portion 35 is formed in a predetermined thickness. Because the recess portion 34 is provided in the rear side of the box pin 10, the lower plate 19*b* formed on the insert pin 9 can be brought into the recess portion 34 when the fastener elements 21 are engaged, so that the box pin 10 and the lower plate 19*b* of the insert pin 9 can be overlapped in a front and rear face direction. Details will be described later on. In the meantime, a width and a length of the recess portion 34 can be set corresponding to a dimension of the lower plate 19*b* formed on the insert pin 9.

Furthermore, as shown in FIG. 11, the hole portion 15 in the box pin 10 is formed in such a manner that the tape pressing member presses the fastener tape 2' when the box pin 10 and the box 11 are injection molded on the fastener tape 2'. Further, the thin leg portion 20 is provided so as to project in a width direction of the fastener tape 2' on a side face of the box pin 10 on a tape inner side. The leg portions 20 are arranged on a front and rear faces of the fastener tape 2' with intervals in a longitudinal direction of the fastener tape 2' with respect to the box 11 and the leg portions 20 on both faces of the fastener tape 2' tightly contact an opposing face of the fastener tape 2'.

Figure 13:
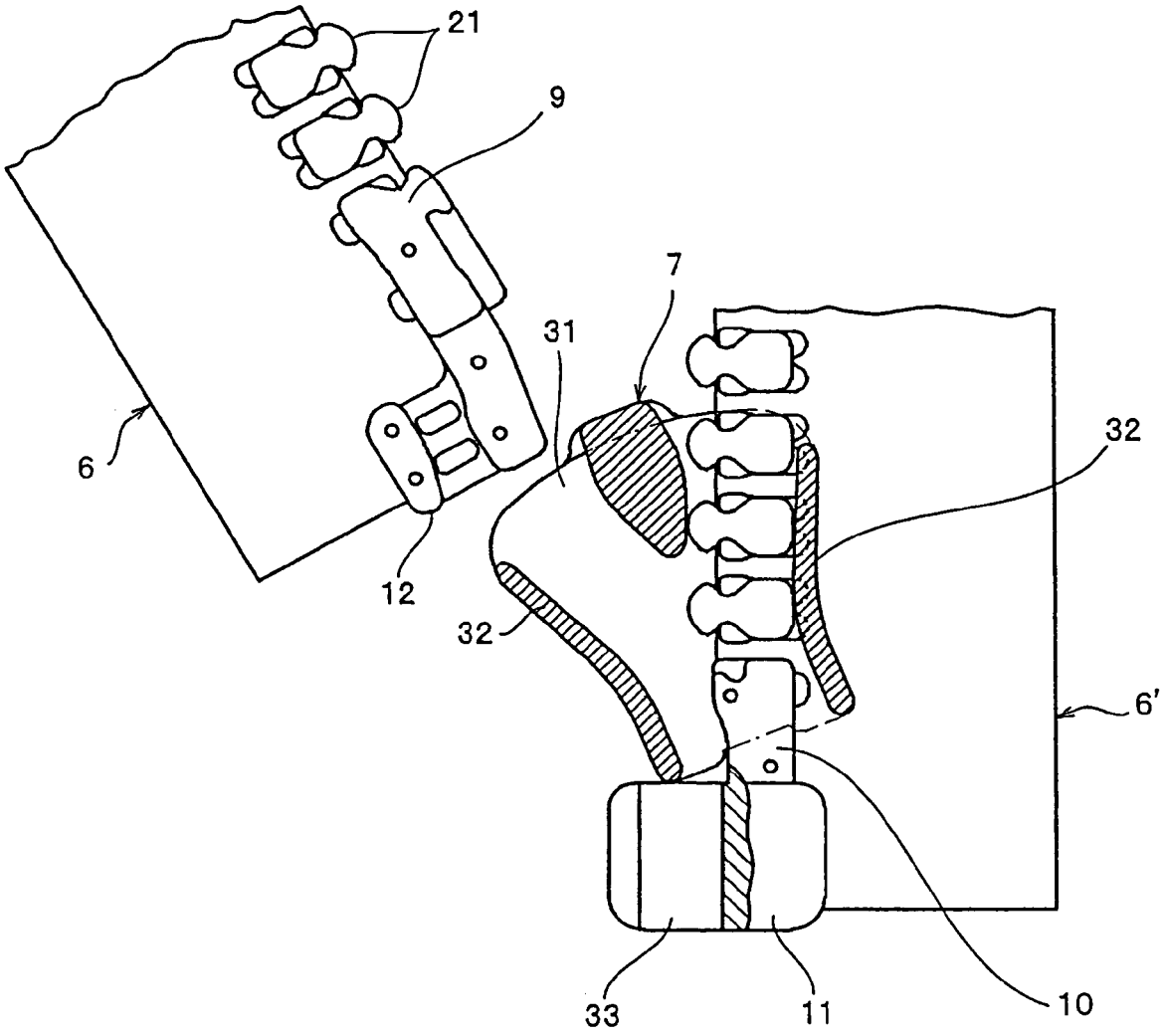
FIG. 13 is a schematic view schematically showing a state in which the insert pin is inserted into a slider.

When the fastener stringer 6 having the insert pin 9 and the insert pin fixing member 12 fixed thereto is mounted to the fastener stringer 6' having the box pin 10 and the box 11 fixed thereto, first, the slider 7 is held in a state in which it makes contact with a top end face of the box 7, as shown in FIG. 13.

Figure 14A:
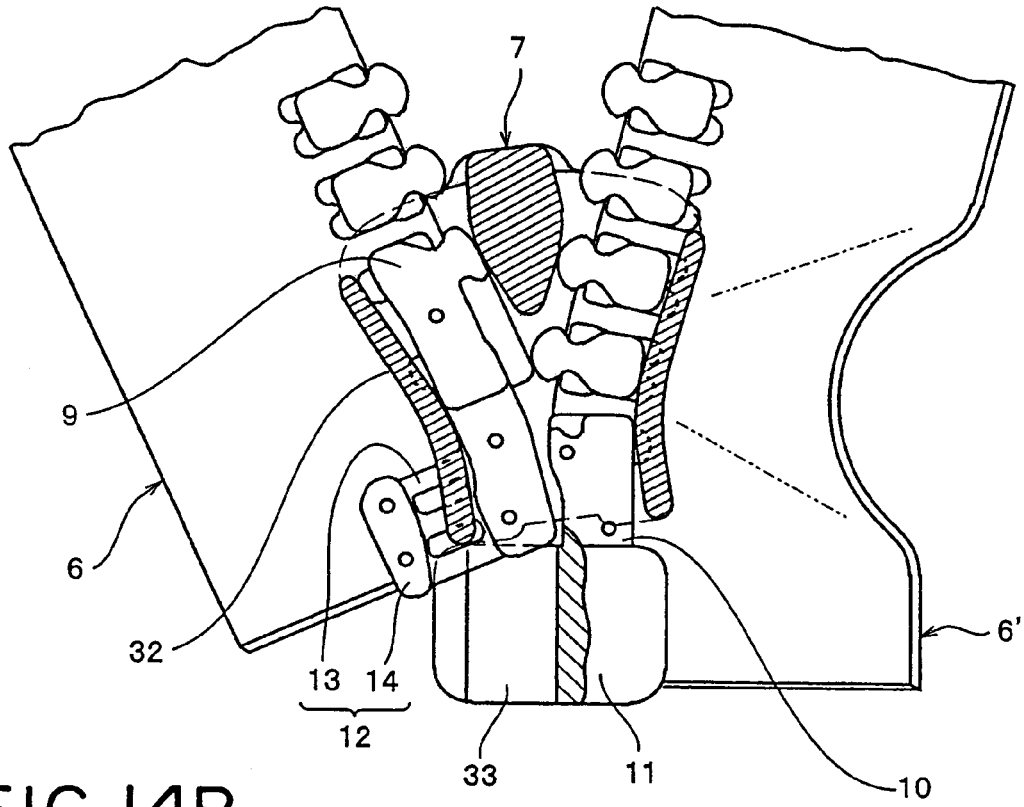
FIG. 14A is a schematic view schematically showing a state in which the insert pin is inserted into the slider.

Next, the insert pin 9 fixed to the fastener stringer 6 is inserted into the guide groove 31 of the slider 7 while bending the fastener tape 2 of the fastener stringer 6' as shown in FIG. 14A, and the thin portion 13 of the insert pin fixing member 12 is inserted between the flanges 32 of the slider 7.

Figure 14B:
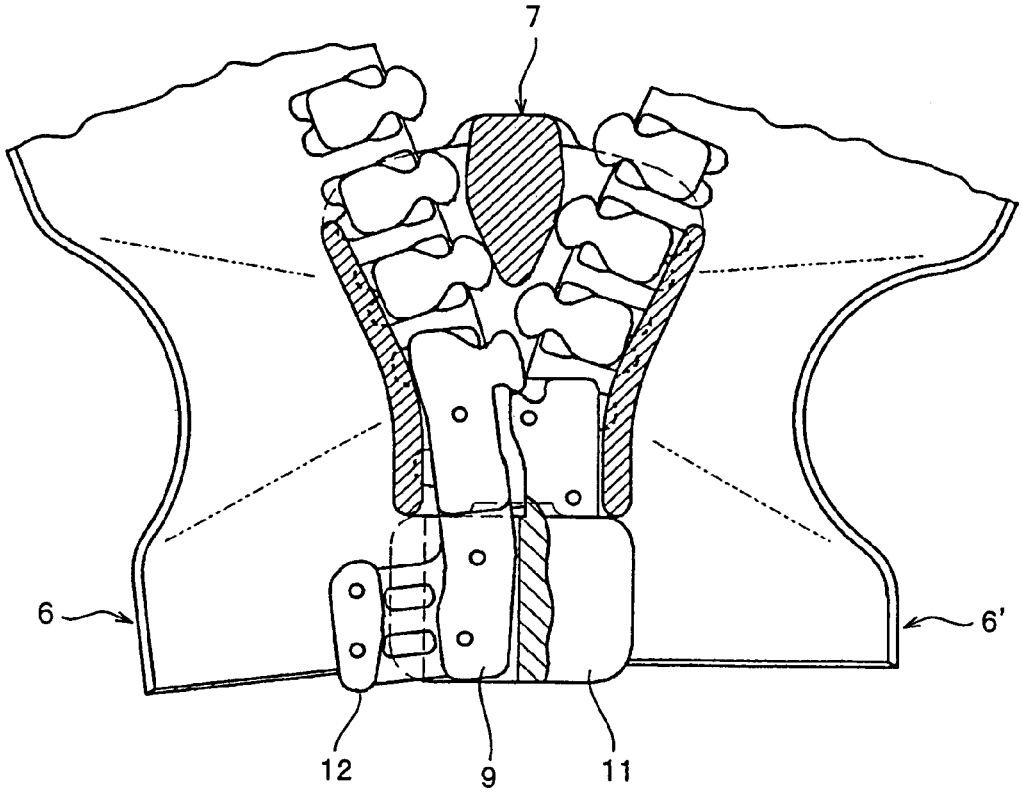
FIG. 14B is a schematic view schematically showing a state in which the insert pin is inserted into an insert pin insertion hole of the box.

Subsequently, as shown in FIG. 14B, the insert pin 9 is inserted into the insert pin insertion hole 33 in the box 11 until the step portion 29 of the insert pin 9 comes into contact with the box 11. At this time, a front end portion of the fastener tape 2 in the fastener stringer 6 is protected so as to be wrapped by the insert pin fixing member 12. For this reason, for example, even if the front end face of the fastener tape 2 comes into contact with a shoulder mouth of the slider 7 or a front end area of the fastener tape rubs against the flanges 32 of the slider 7, the front end portion of the fastener tape 2 can be prevented from being unraveled or damaged.

The length of the insert pin fixing member 12 is set shorter than the insert pin 9, the fastener tape 2 is exposed in the upper area 36 above the insert pin fixing member 12, and further, the respective leg portions 20 of the insert pin 9 are disposed at a predetermined interval in a small area. Consequently, the fastener tape 2 can be bent easily as shown in FIG. 4B when the insert pin 9 is inserted into the insert pin insertion hole 33 of the box 11, which enables the insertion of the insert pin 9 to be achieved easily and smoothly.

Figure 15:
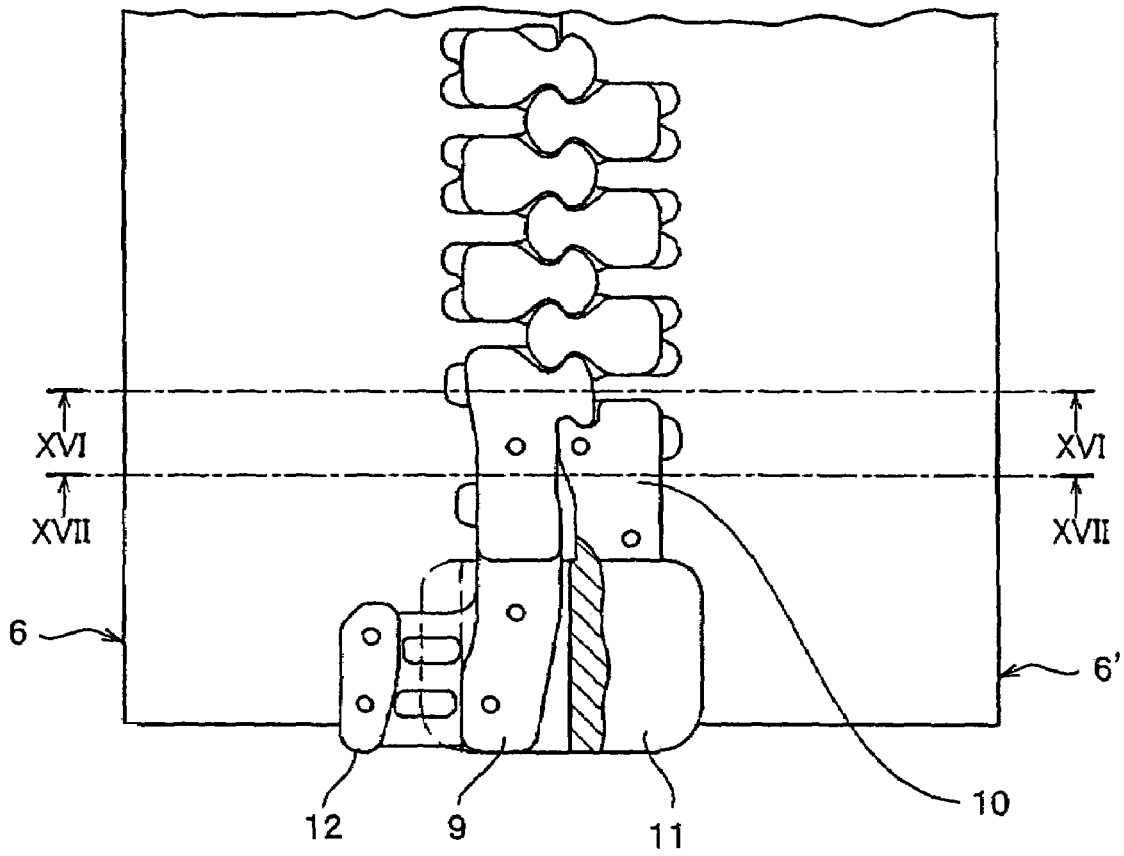
FIG. 15 is a schematic view schematically showing a state in which fastener elements are engaged.

As described above, the slider 7 is slid by pulling upward after the insert pin 9 is inserted into the insert pin insertion hole 33 of the box 11. As a result, as shown in FIG. 15, the fastener elements 21 of the fastener stringers 6, 6' can be engaged with each other, and the top end portions of the upper plate 19*a* and the lower plate 19*b* of the insert pin 9 can be engaged with the top end portions of the fastener element 21 fixed to the bottom end of the element row of the fastener tape 2' on the box pin side and the box pin 10.

The insert pin 9 and the box pin 10 each include the leg portion 20, and each fastener element 21 includes two-branched leg portions 26. Accordingly, the leg portions 20, 26 make contact with the flanges 32 of the slider 7 when the slider 7 is slid, thereby preventing the flanges 32 from coming into direct contact with the fastener tape 2. Therefore, the waterproof layer covering the fastener tape 2 can be protected from being worn or damaged by the flanges 32 to prevent the waterproof performance of the slide fastener 1 from dropping.

By engaging the fastener elements 21 of the opposing fastener stringers 6, 6', end faces of element mounting edge portions 3, of the fastener tapes 2, 2' can be brought into a firm contact with each other in an area in which the fastener elements 21 are arranged.

Figure 16:
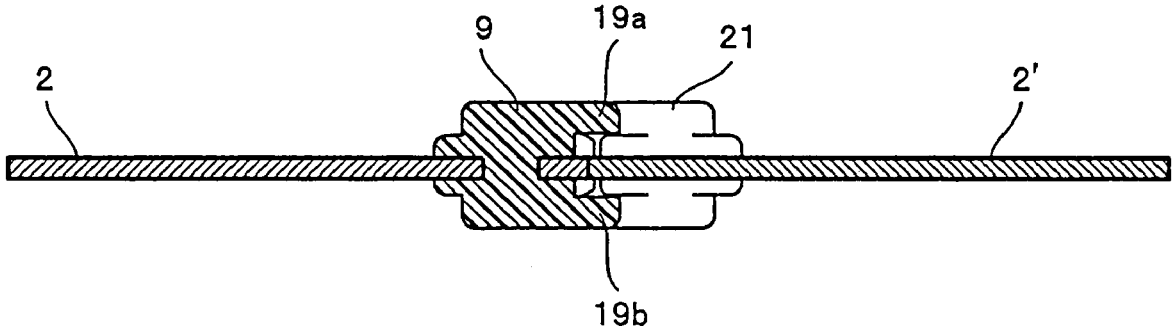
FIG. 16 is a sectional view seen in a direction of arrows along a line XVI-XVI in FIG. 15.

Further, according to this embodiment, the fastener tape 2 is projected into a gap between the upper plate 19*a* and the lower plate 19*b* from the side face of the insert pin 9 through the tape nipping groove portion 18 in the insert pin 9. Accordingly, as shown in FIG. 16, the end face of the fastener tape 2 extending from the insert pin 9 can be brought into a firm contact with the end face of the opposing fastener tape 2' when the fastener elements 21 are engaged.

Figure 17:
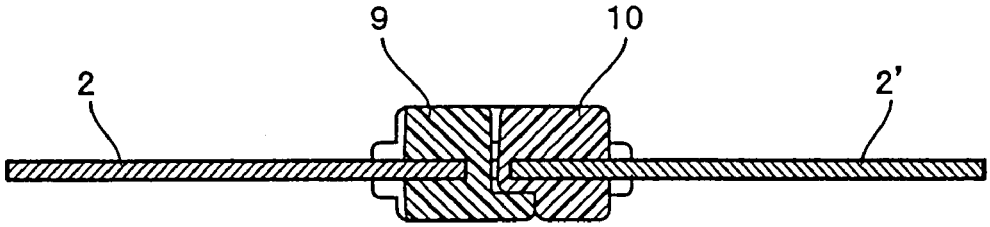
FIG. 17 is a sectional view seen in a direction of arrows along a line XVII-XVII in FIG. 15.
Figure 18:
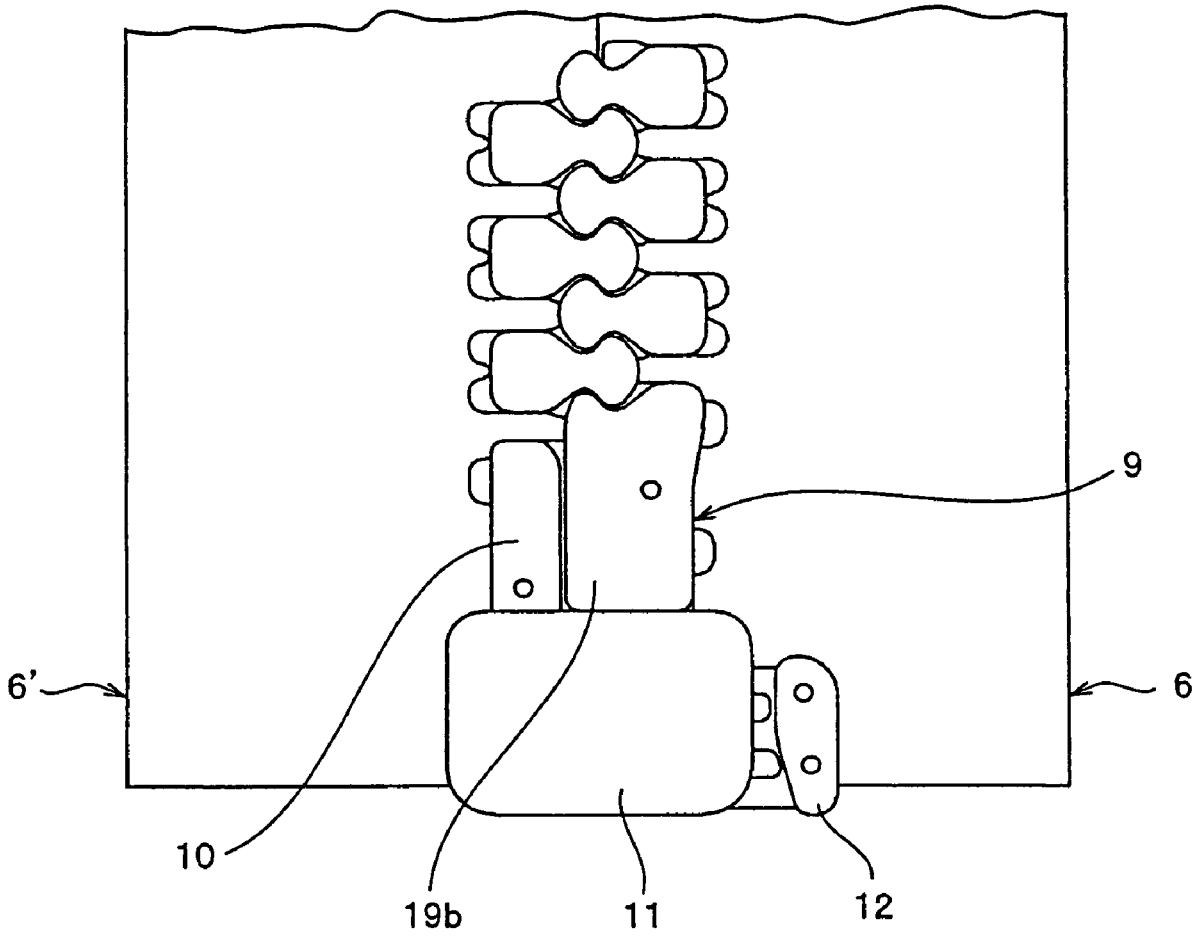
FIG. 18 is a rear view schematically showing a state in which the fastener elements are engaged from the rear face of the tape.

Furthermore, when the fastener elements 21 are engaged, the lower plate 19*b* disposed on the rear face of the insert pin 9 is introduced into the recess portion 34 formed on the rear face of the box pin 10 as shown in FIG. 17, so that the lower plate 19*b* opposes the recess portion 34 in the box pin 10. Consequently, the lower plate 19*b* and the box pin 10 overlap each other in the front and rear face direction to clog the gap formed between the insert pin 9 and the box pin 10. Preferably, the lower plate 19*b* is brought into contact with the recess portion 34 in the box pin 10 to seal the gap between the insert pin 9 and the box pin 10.

In the waterproof slide fastener 1 of this embodiment, the end faces of the fastener tapes 2, 2' can be brought into a firm contact with each other in an area in which the fastener tape 2 is extended from the insert pin 9 as well as in an area in which the fastener elements 21 are arranged when the fastener elements 21 are engaged. At the same time, the gap between the insert pin 9 and the box pin 10 can be clogged by the lower plate 19*b* disposed on the insert pin 9. In the waterproof slide fastener 1 of this embodiment, contact area between the fastener stringers 6 an 6' can be increased by reducing the gap generated therebetween as compared with a conventional type, thereby intensifying the waterproof performance of the slide fastener 1.

As described above, the waterproof slide fastener 1 of this embodiment can prevent the insert pin 9 from slipping out of the fastener tape even when the fastener tape 2 receives a stress or torsion because the fixing strength between the insert pin 9 and the fastener tape 2 is intensified by providing the insert pin fixing member 12. Further, the insert pin fixing member 12 protects the front end portion of the fastener tape on an insert pin fixing side so as to wrap the portion. Accordingly, the front end portion of the fastener tape 2 can be prevented from being unraveled or damaged even if the insertion of the insert pin 9 into the box 11 is repeated. Moreover, such an excellent operation and effect of improving the waterproof performance of the slide fastener 1 can be obtained.

This embodiment has been described mainly about a case where the separable bottom end stop secured to one end portion of the waterproof slide fastener is comprised of the insert pin, the box pin and box. However, the present invention is not restricted to this example, but the present invention may be modified in various ways as long as substantially a same configuration as the present invention is possessed.

The present invention can be applied to, for example, a waterproof slide fastener which can be opened reversely as well as the waterproof slide fastener having normal type separable bottom end stop comprised of the box, box pin and insert pin. The waterproof slide fastener which can be opened reversely is a waterproof slide fastener in which a reverse opening slider is mounted on fastener elements as well as the normal slider with the insert pin and box pin fixed integrally to one end portion of the fastener tape such that they oppose each other and without the box, as shown in FIG. 19.

Hereinafter, the waterproof slide fastener which can be opened reversely will be described in detail with reference to FIG. 19. Since reference numerals are attached to components having the same configuration as the waterproof slide fastener of the above-described embodiment in FIGS. 19 and 20, description thereof is omitted.

Figure 19:
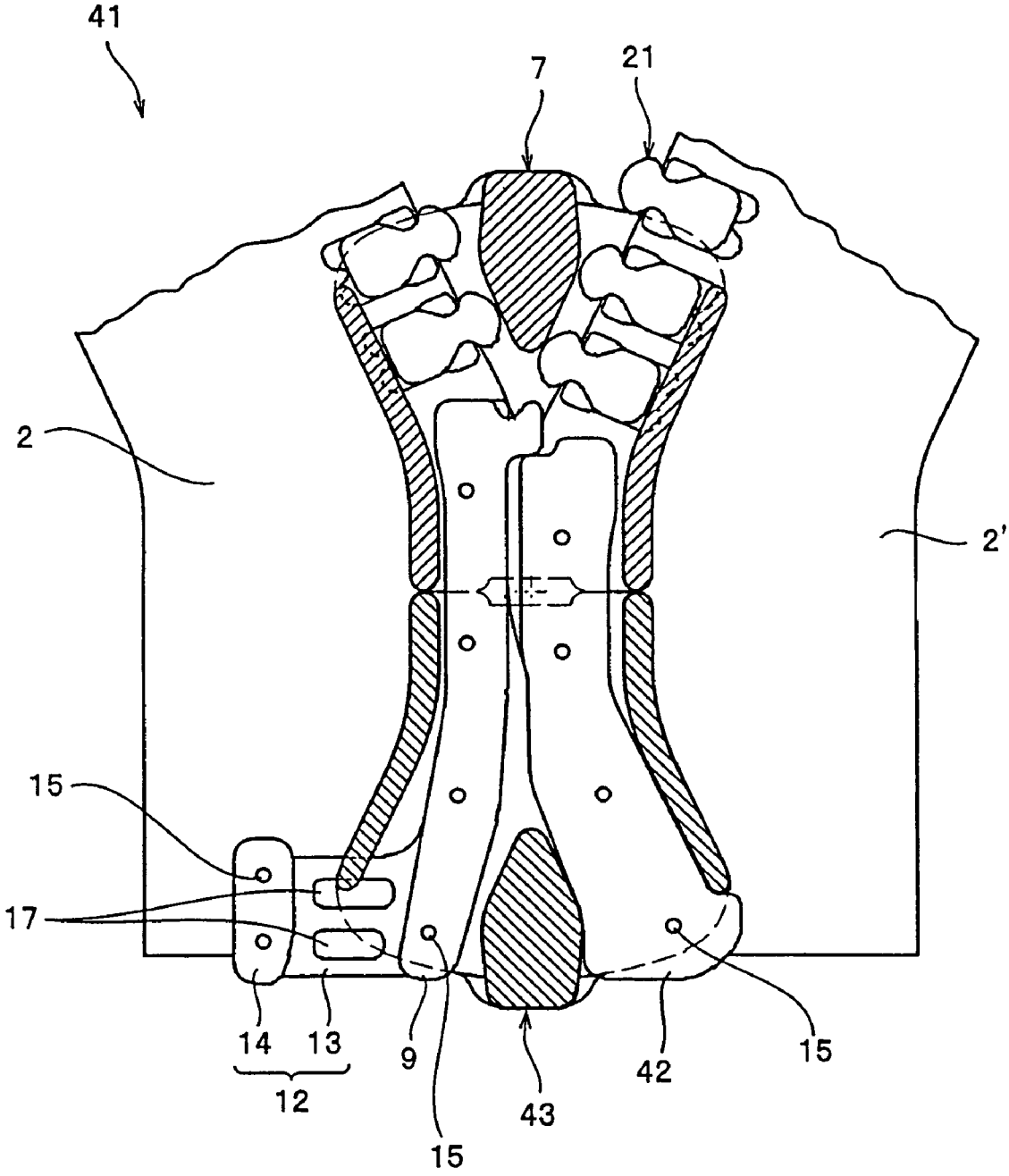
FIG. 19 is a schematic view schematically showing a configuration of a waterproof slide fastener which can be opened reversely.

The waterproof slide fastener 41 which can be opened reversely shown in FIG. 19 includes a box pin 42 fixed integrally to one end portion of a fastener tape 2' but no member serving as the box. A reverse opening slider 43 arranged in an opposite direction to the slider 7 as well as the slider 7 is mounted on fastener elements 21 arranged along element mounting edge portions of opposing fastener tapes 2, 2'. Consequently, the fastener elements 21 can be engaged or disengaged by both the slider 7 and the reverse opening slider 43.

In the waterproof slide fastener 41 which can be opened reversely, an insert pin fixing member 12 extending from the fastener tape 2 from part of a side face of an insert pin 9 fixed to one end portion of the fastener tape 2 is fixed to both front and rear faces of the fastener tape 2 such that it strides over front end faces on an insert pin fixing side of the fastener tape 2. In the meantime, this insert pin fixing member 12 is formed shorter than the insert pin 9 in a tape length direction.

Accordingly, the waterproof slide fastener 41 which can be opened reversely can exert the same effect as the waterproof slide fastener 1 of the above-described embodiment. That is, the waterproof slide fastener 41 which can be opened reversely having the insert pin fixing member 12 can prevent the insert pin 9 from slipping out of the fastener tape even if the fastener tape 2 receives a stress or torsion, because the fixing strength between the insert pin 9 and the insert pin fixing member 12 and the fastener tape 2 can be intensified. Further, because the insert pin fixing member 12 protects the front end portion of the fastener tape on the insert pin fixing side such that it wraps, the front end portion of the fastener tape 2 can be prevented from being unraveled or damaged.

According to the present invention, the same fixing member as the insert pin fixing member 12 can be fixed integrally to both the front and rear faces of the fastener tape on the box pin side of the waterproof slide fastener which can be opened reversely such that it extends from a side face of the tape end side of the box pin.

Figure 20:
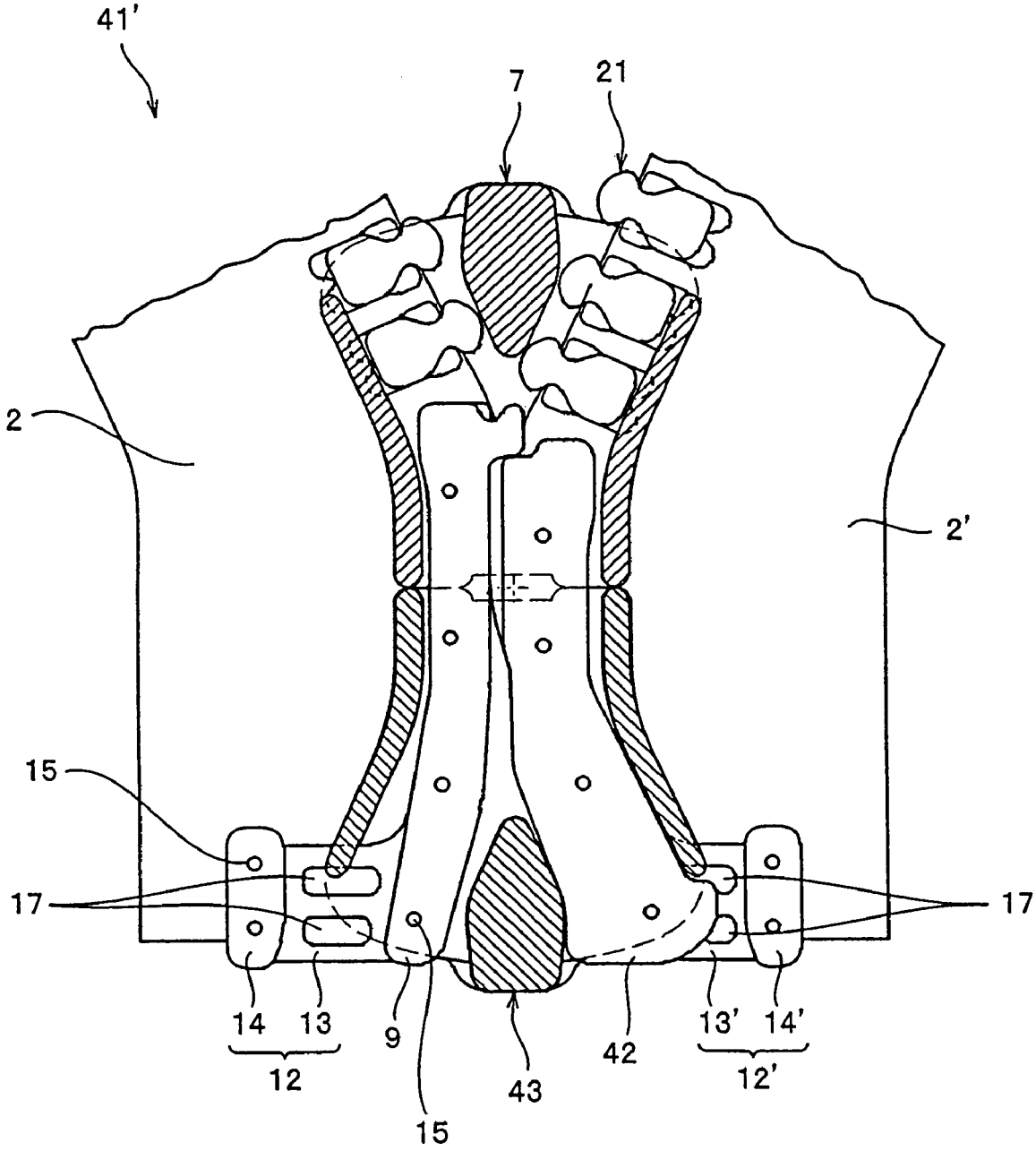
FIG. 20 is a schematic view schematically showing a configuration of a modification of the waterproof slide fastener which can be opened reversely.
Figure 21A:
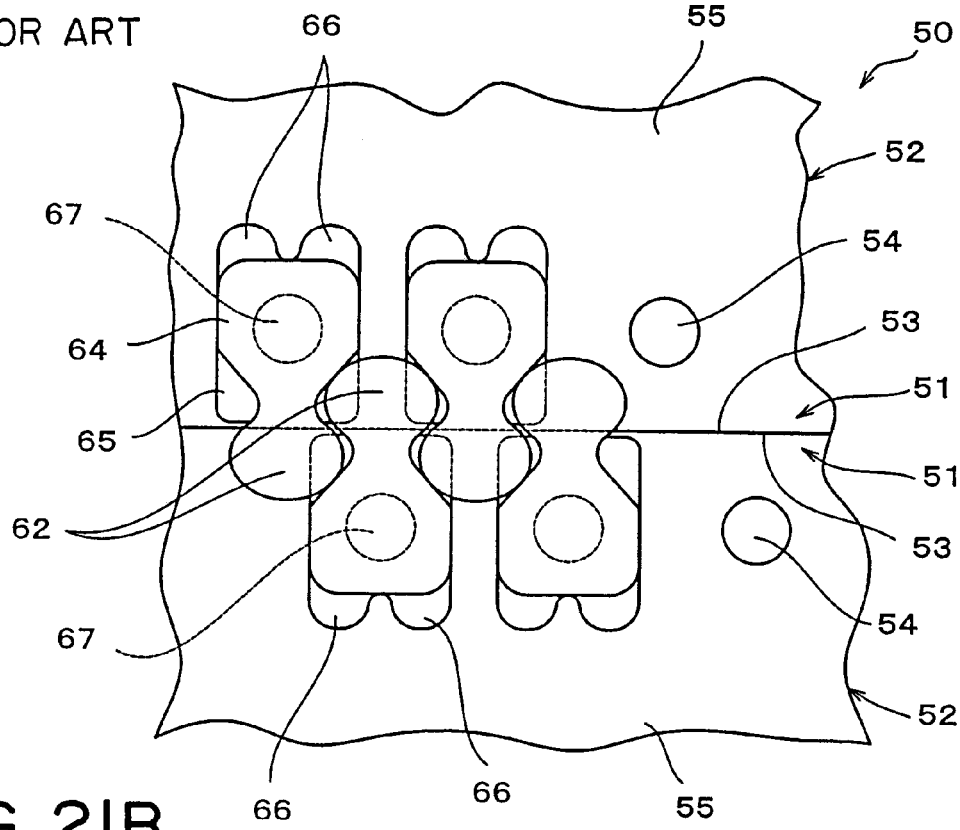
FIG. 21A PRIOR ART
FIG. 21A is a plan view showing mainly a coupling portion of a conventional waterproof slide fastener.
Figure 21B:
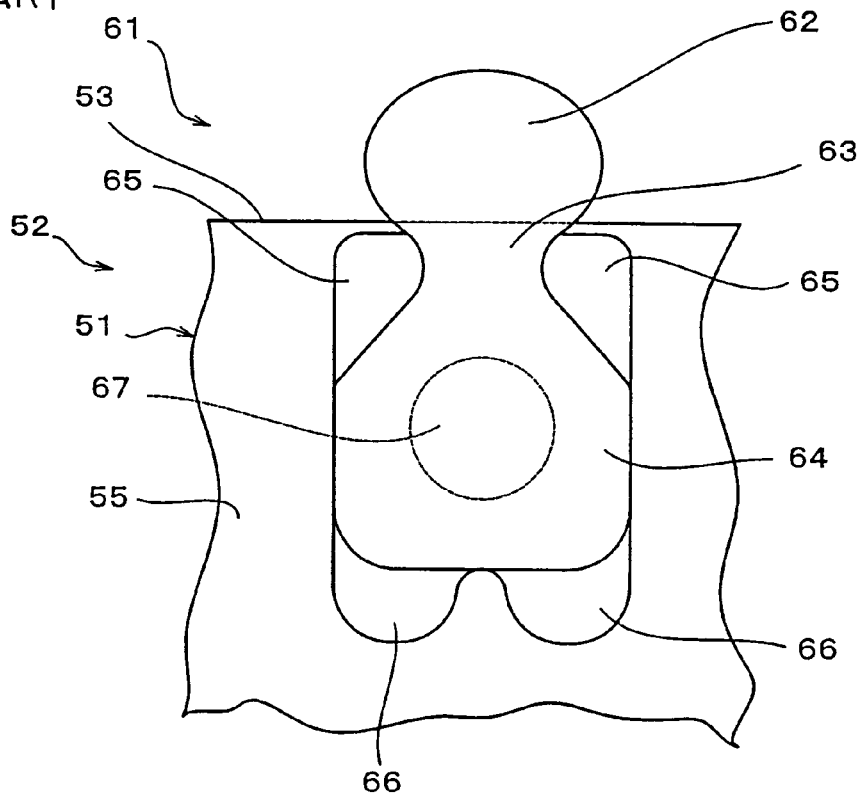
FIG. 21B PRIOR ART
FIG. 21B is an enlarged plan view showing one fastener element of a fastener stringer of the waterproof slide fastener.

As shown in FIG. 20, a box pin fixing member 12' fixed on one end portion of the fastener tape 2' so as to extend over the fastener tape 2' from part of a side face of the box pin 42 is fixed to both the front and rear faces of the fastener tape 2'. The box pin fixing member 12' formed integrally with the box pin 42 is formed striding across the front and rear faces of the tape 2' so as to cover the front end face on the box pin fixing side of the fastener tape 2'. The box pin fixing side front end portion of the fastener tape 2' is wrapped by the box pin fixing member 12'.

The box pin fixing member 12' has a thin portion 13' having a small thickness extending from the side face of the box pin 42, and a rib 14' adjoining the thin portion 13'. The thin portion 13' and the rib 14' are formed shorter than the box pin 42 in a tape length direction.

That is, because the waterproof slide fastener which can be opened reversely is provided with no box as described above, the insert pin may slip out of the fastener tape easily when the box pin receives a tensile stress or torsion. Accordingly, the fixing strength of the box pin 42 to the fastener tape 2' can be intensified considerably by fixing the box pin fixing member 12' to both the front and rear faces of the tape by forming it integrally with the box pin 42 as shown in FIG. 20, thereby preventing the box pin 42 from slipping out of the fastener tape 2'.

Further, because the box pin fixing member 12' protects the front end portion of the fastener tape on the box pin fixing side such that it wraps, the front end portion of the fastener tape 2' can be prevented from being unraveled or damaged.

The present invention can be applied to the waterproof slide fastener effectively in which the fastener tape is coated with the waterproof layer composed of elastomer resin while the insert pin and box pin are fixed integrally to each end portion of the pair of fastener tapes.

What is claimed is:

1. A waterproof slide fastener in which a plurality of fastener elements are arranged along flat element mounting edge portions opposing each other of a pair of waterproof fastener tapes having a waterproof layer for covering a surface of a belt-like core material, and an insert pin and a box pin are fixed integrally to both front and rear faces in a flat shape at end portions having no fastener elements of the pair of fastener tapes on one side in a longitudinal direction, the waterproof slide fastener comprising:

a slider inserted through the fastener elements;

an insert pin fixing member extending from part of a side face on a tape end side of the insert pin over both the front and rear faces of one of the fastener tapes and being fixed integrally thereto; and upper and lower plate members extending outwardly with a predetermined gap in parallel to the front and rear faces of the fastener tape, the plate members being provided on both the front and rear faces on an end portion of the insert pin on a fastener element side, wherein an end portion of the insert pin fixing member fixed integrally to both the front and rear faces of the fastener tape covers a front end face of the fastener tape on an insert pin fixing side so as to stride across the front and rear faces of the fastener tape, the gap between the upper and lower plate members is formed to be larger than a thickness of the fastener tape to which the box pin has been fixed, and when the fastener elements are engaged, the gap between the upper and lower plate members accommodates part of an edge of the fastener tape on a box pin side.

2. The waterproof slide fastener according to claim 1, wherein the insert pin fixing member is formed shorter than the insert pin in a tape length direction.

3. The waterproof slide fastener according to claim 1, wherein at least one through hole is formed in an area including the insert pin and the insert pin fixing member of the fastener tape, and front faces and rear faces of the insert pin and the insert pin fixing member fixed on both the front and rear faces of the fastener tape are connected by a connecting portion through the through hole in the fastener tape.

4. The waterproof slide fastener according to claim 1, wherein part of an end portion of the fastener tape disposed at the end portion of the insert pin on the fastener element side is formed so as to project into the gap, and a length of the projection into the gap is a length which brings an end face of the fastener tape projecting from the gap into a firm contact with an end face of the fastener tape on a side at which the opposing box pin is fixed when the fastener elements (21) are engaged.

5. The waterproof slide fastener according to claim 1, wherein the lower plate member disposed on the insert pin is formed in a predetermined length in a tape length direction from the end portion of the insert pin on the fastener element side.

6. The waterproof slide fastener according to claim 1, wherein a leg portion smaller than the insert pin fixing member is disposed on a side face of the insert pin on a side having the insert pin fixing member.

* * * * *